US011459674B2

(12) United States Patent
Zhou

(10) Patent No.: US 11,459,674 B2
(45) Date of Patent: Oct. 4, 2022

(54) IMPURITY REMOVAL SYSTEM FOR REFINING COTTON

(71) Applicant: HUBEI JINHANJIANG REFINED COTTON CO., LTD, Hubei (CN)

(72) Inventor: Hangxu Zhou, Hubei (CN)

(73) Assignee: HUBEI JINHANJIANG REFINED COTTON CO., LTD.

( * ) Notice: Subject to any disclaimer, the term of this patent is extended or adjusted under 35 U.S.C. 154(b) by 0 days.

(21) Appl. No.: 17/151,164

(22) Filed: Jan. 17, 2021

(65) Prior Publication Data

US 2022/0042210 A1 Feb. 10, 2022

(30) Foreign Application Priority Data

Aug. 6, 2020 (CN) ..... 202021620077.6

(51) Int. Cl.
*D01G 9/10* (2006.01)
*D01G 9/12* (2006.01)
*D01G 9/22* (2006.01)

(52) U.S. Cl.
CPC ..... *D01G 9/10* (2013.01); *D01G 9/12* (2013.01); *D01G 9/22* (2013.01)

(58) Field of Classification Search
CPC ... D01B 1/04; D01G 9/00; D01G 9/06; D01G 9/08; D01G 9/10; D01G 9/12; D01G 9/14; D01G 9/18; D01G 9/22; B01D 23/00; B07B 1/00; B07B 4/08
USPC ..... 19/40, 41, 107, 200, 204; 55/315; 241/24.21
See application file for complete search history.

(56) References Cited

U.S. PATENT DOCUMENTS 876,576 A * 1/1908 McDonald ..... D01G 9/00 19/93
1,401,439 A * 12/1921 Pettit ..... D01B 1/04 19/80 R
1,721,932 A * 7/1929 Streun ..... D01B 1/04 19/37
3,432,892 A * 3/1969 Case ..... D01G 9/00 19/203
4,300,267 A * 11/1981 Winch ..... D01G 9/00 19/107

(Continued)

FOREIGN PATENT DOCUMENTS

CN 201186966 Y * 1/2009
CN 101705540 A 5/2010

(Continued)

*Primary Examiner* — Khoa D Huynh
*Assistant Examiner* — Aiying Zhao

(57) ABSTRACT

An impurity-removal system for refining cotton is provided. In the system, the bottom of the first bin shell is open, and the top of the first bin shell is provided with a first discharge opening, the air inlet of the first induced draft fan communicates with through a first air duct. The front wall of the first bin shell is provided with a first feeding opening, from which the rear of the conveying mechanism penetrates into the first bin shell, and the pressuring roller is installed on the first feeding opening of the first bin shell, and located above the mechanism. The first opening roller is movably installed in the first bin shell, located at the rear of the conveying mechanism, and first saw teeth in a row are set on the periphery of the first opening roller. The first motor is drivingly connected with the first opening roller.

16 Claims, 20 Drawing Sheets

(56) References Cited

U.S. PATENT DOCUMENTS

| | | | | | |
|---|---|---|---|---|---|
| 4,974,293 | A * | 12/1990 | Baker | D01B 1/02 19/37 |
| 2011/0284432 | A1* | 11/2011 | Van den Hurk | A01F 29/005 209/643 |
| 2018/0266020 | A1* | 9/2018 | Zhou | B01D 50/002 |

FOREIGN PATENT DOCUMENTS

| | | | | |
|---|---|---|---|---|
| CN | 202683488 | U * | 1/2013 | |
| CN | 203513545 | U * | 4/2014 | |
| CN | 204752945 | U | 11/2015 | |
| CN | 205035518 | U | 2/2016 | |
| CN | 106544761 | A * | 3/2017 | |
| CN | 108708002 | A * | 10/2018 | |
| CN | 109868509 | A * | 6/2019 | |
| CN | 209178534 | U | 7/2019 | |
| GB | 730149 | A * | 5/1955 | D01G 9/00 |

* cited by examiner

IMPURITY REMOVAL SYSTEM FOR REFINING COTTON

FIELD

The present invention relates to the technical field of impurity-removal devices, more specifically to the technical field of an impurity-removal device for refining cotton.

BACKGROUND

Refined cotton is white cotton fibre made of cotton linters after processing and being refined. As raw cotton linters are the fibre that is stripped by a delinter from short fibre on cotton seeds, the fibre is often mixed with various impurities, so it is particularly important to remove impurities during the production process. The impurity-removal for refining cotton generally comprises the steps such as opening-and-impurity-removal, gravity impurity-removal, drum impurity-removal, secondary opening-cleaning and impurity-removal, but the various impurity-removal devices involved in the impurity-removal process have many shortcomings. Among them, the opening-and-impurity-removal device has the following shortcomings. Before processing the raw cotton linters, the slabs formed by compressing them need to be shredded and broken up. While the cotton linters are opened in an opener, they also go through an opening-cleaning process. After opening and impurity-removal, the cotton linters are sucked away by the wind. However, during the opening process, some of the cotton linters are not completely shredded and broken up by a traditional opener, so it is difficult to suck them away by the wind. This part of the cotton linters, accumulating more and more in the opener, not only affects the opening efficiency, but also reduces the opening-and-impurity-removal effect. The gravity impurity-removal device and the drum impurity-removal device have the following shortcomings. The impurity-removal effect is not very satisfactory, and the cotton linters after the impurity-removal still contain more impurities. The secondary opening-cleaning and impurity-removal device has the following shortcomings. The current common secondary opening-and-impurity-removal device is not very satisfactory in both the opening effect and the impurity-removal effect, which does not facilitate subsequent processing of cotton linters and adversely affects the quality of the final refined cotton.

SUMMARY

The object of the present invention is to solve the above-mentioned shortcomings and provide an impurity-removal system for refining cotton that can improve the opening-and-impurity-removal effect, facilitate the subsequent processing and improve the quality of refined cotton.

In order to solve the above-mentioned technical problem, the technical solutions adopted in the present invention are as follows.

An impurity-removal device for refining cotton comprises an opening-and-impurity-removal mechanism, a gravity impurity-removal mechanism, a drum impurity-removal mechanism and a secondary opening-and-impurity-removal mechanism. The opening-and-impurity-removal mechanism comprises a first bin shell, a first induced draft fan, a conveying mechanism, a pressing roller, a first opening roller, a second opening roller, a first motor, a second motor, a screw rod, a sliding seat, a first rotary shaft, a third motor, a fourth motor, a first bottom plate and a second bottom plate. The bottom of the first bin shell is open, and the top of the first bin shell is provided with a first discharge opening, which the air inlet of the first induced draft fan communicates with through a first air duct. The front wall of the first bin shell is provided with a first feeding opening, from which the rear part of the conveying mechanism penetrates into the first bin shell, and the pressuring roller is movably installed on the first feeding opening of the first bin shell, and located above the conveying mechanism. The first opening roller is movably installed in the first bin shell, located at the rear end of the conveying mechanism, and first saw teeth in a row are set on the periphery of the first opening roller. The first motor is drivingly connected with the first opening roller. The second opening roller is movably installed in the first bin shell, and second saw teeth in a row are set on the periphery of the second opening roller. The second motor is drivingly connected with the second opening roller. The first bottom plate and the second bottom plate are respectively fixedly installed in the first bin shell below the first opening roller and the second opening roller. The first bottom plate and the second bottom plate respectively present an arc shape corresponding to the first opening roller and the second opening roller. An impurity-discharging hole is set on the second bottom plate, and the inner top of the first bin shell is provided with a pair of supporting plates, between which a guiding column is set. The third motor is fixedly installed on the outer wall of the first bin shell. The screw rod is movably installed on the pair of supporting plates, and one end of the screw rod penetrates from the first bin shell and is drivingly connected with the third motor. A through hole and a screw hole are set on the sliding seat, which movably encircles the guiding column through the through hole, and the screw rod is rotationally set in the screw hole of the sliding seat. The first rotary shaft is movably installed on the sliding seat, on which the fourth motor is fixedly installed, and is drivingly connected with the first rotary shaft, and stirring rods in a row are set on the first rotary shaft. The gravity impurity-removal mechanism comprises a second bin shell, a sixth motor, a middle shaft, a sieving hopper, a seventh motor, a second rotary shaft, a cam, a pulley, a covering plate and a second induced draft fan. A second feeding opening is set on the side of the second bin shell, the top of which is provided with a second discharging opening. The air outlet of the first induced draft fan communicates with the second feeding opening through a first pipe, and the air inlet of the second induced draft fan communicates with the second discharging opening through a second air duct. The bottom of the second bin shell is provided with a first impurity-discharging opening, and the covering plate is hinged and set at first impurity-discharging opening of the second bin shell. A locking mechanism is set between the second bin shell and the covering plate, and a guiding hole is set on the inner side wall of the second bin shell, in which the sieving hopper is located. The bottom of the sieving hopper is provided with a guiding column, which is movably inserted in the guiding hole. A first sieving hole is set on the bottom wall of the sieving hopper, and an axis hole is set on the top wall of the second bin shell. The middle shaft is movably inserted into the second bin shell through the axis hole, and the sixth motor is drivingly connected to the middle shaft. The middle shaft is provided with a transverse rod, which is provide with a raking rod, and the raking rod extends downward into the sieving hopper. The second rotary shaft is movably inserted in the second bin shell, and the cam is fixedly installed on the second rotary shaft. The pulley is movably installed on the cam, and the pulley corresponds with the bottom of the sieving hopper.

The seventh motor is drivingly connected with the second rotary shaft. The drum impurity-removal mechanism comprises a fourth bin shell, a third induced draft fan, a fourth induced draft fan, a drum, a thirteenth motor, a fourteenth motor, a connecting sleeve and a fourth rotary shaft. The side part of the fourth bin shell is provided with a fourth feeding opening, which the air outlet of the second induced draft fan communicates with. The drum is movably installed in the fourth bin shell, and is tube shaped, and first mesh is set on the peripheral wall of the drum. A first scraper is set at the fourth feeding opening inside the fourth bin shell, opposite the outer peripheral wall of the drum. One end of the drum is provided with an impurity-discharging pipe, the outer periphery of which is provide with an annular hump. The connecting sleeve is fixedly installed on the outer wall of the fourth bin shell, and the impurity-discharging pipe is movably stuck in the connecting sleeve through the annular hump, and communicates with the connecting sleeve. The third induced draft fan communicates with the connecting sleeve through a third air duct, and the thirteenth motor is drivingly connected with the drum. The bottom of the fourth bin shell is provided with a discharging pipe, the two side walls of which are provided with arc plates having the same centre and the same radius, respectively. An impurity-absorbing cavity is set on the outer side of the arc plate on one side, and second mesh communicating with the impurity-absorbing cavity is set on that arc plate, and an impurity-outlet is set on the outer wall of the impurity-absorbing cavity. The fourth induced draft fan communicates with the impurity-outlet through a fourth air duct. The fourth rotary shaft is movably inserted in the discharging pipe, and a second scraper is set on the fourth rotary shaft, opposite the inner side wall of the arc plate. The fourteenth motor is drivingly connected with the fourth shaft. The secondary opening-and-impurity-removal mechanism comprises a third bin shell, a pair of first lickers-in, a second licker-in, an eighth motor, a ninth motor, a vibrating sieve plate, a tenth motor, a third rotary shaft, a connecting rod, a conveying shaft, an eleventh motor, a third opening roller and a twelfth motor. A third feeding opening is set on the top of the third bin shell, and the discharging pipe is connected to the third feeding opening through a second pipe. A division plate is set in the third bin shell, and an impurity-discharging channel is formed between the division plate and the inner wall of one side of the third bin shell. The bottom of the third bin shell is provided with a conveying trough, at the bottom of which a second impurity-discharging opening is set. A lifting channel communicating with the inside of the third bin shell is set on the side of the third bin shell, and a third discharging opening is set at the upper end of the lifting channel. An impurity-leaking plate is set in the third bin shell and the lifting channel, and the two ends of the impurity-leaking plate are fixed at the division plate and the third discharging opening of the lifting channel, respectively. The pair of first lickers-in are respectively movably installed at the third feeding opening of the third bin shell. The periphery of the first lickers-in is provide with a first spike, and the eighth motor is drivingly connected with the pair of first lickers-in. The second licker-in is movably installed in the third bin shell below the pair of the first lickers-in, a second spike is set on the periphery of the second licker-in, and the ninth motor is drivingly connected with the second licker-in. The third rotary shaft is movably inserted in the third bin shell, and a flying wheel disk is set on the third rotary shaft. One end of the vibrating sieve plate is hinged to the inner wall of the third bin shell, one end of the connecting rod is hinged to the flying wheel disk, and the other end of the connecting rod is hinged to the other end of the vibrating sieve plate. The vibrating sieve plate is located above the impurity-discharging channel and below the second licker-in. A second sieving hole is set on the vibrating sieve plate, and the tenth motor is drivingly connected with the third rotary shaft. The conveying shaft is movably installed in the conveying trough, and a spiral rib plate is set on the conveying shaft, and the eleventh motor is drivingly connected to the conveying shaft. The third opening roller is movably installed in the third bin shell and the lifting channel with an incline, respectively, and third saw teeth are set on the periphery of the third opening roller, respectively. The impurity-leaking plate is located below the third opening roller, and the impurity-leaking plate presents a continuous arc corresponding to the third opening rollers in a row, one to one. Impurity-leaking holes are set on the impurity-leaking plate, and the twelfth motor is in drivingly connected with the third opening rollers in a row.

The opening-and-impurity-removal mechanism further comprises a pair of corrugated dust-proof sleeves. The pair of corrugated dust-proof sleeves respectively encircle the outside of the screw rod. One end of the pair of corrugated dust-proof sleeves is fixedly connected with the sliding seat, and the other end of the pair of corrugated dust-proof sleeves is fixedly connected with the pair of supporting plates.

The conveying mechanism comprises a frame, a conveying roller, a conveying belt and a fifth motor. The conveying rollers are movably installed in a row on the frame through a third bearing. A pair of lateral obstructing plates are set on the frame, and located on both sides of the conveying roller. The conveying belt is wound on the conveying rollers in a row, and a fifth belt pulley is set on the conveying roller at the rearmost end. The fifth motor is fixedly installed on the first bin shell, and a sixth belt pulley is set on the output shaft of the fifth motor, and is belt-drivingly connected to the fifth belt pulley.

The first opening roller is movably installed in the first bin shell through a first bearing, and the second opening roller is movably installed in the first bin shell through a second bearing. The first motor and the second motor are respectively fixedly installed on the side wall of the first bin shell. A first belt pulley is set at one end of the first opening roller, and a second belt pulley is set on the output shaft of the first motor, and belt-drivingly connected to the first belt pulley. A third belt pulley is set at one end of the second opening roller, a fourth belt pulley is set on the output shaft of the second motor, and belt-drivingly connected to the third pulley. The pressuring roller is movably installed at the first feeding opening of the first bin shell through a fourth bearing. One end of the screw rod is drivingly connected with the third motor through a first coupling. The first rotary shaft is movably installed on the sliding seat through a fifth bearing. The fourth motor is drivingly connected to the first rotary shaft through a second coupling.

The gravity impurity-removal mechanism further comprises a sealing gasket, a bearing seat, a thrust bearing, a first radial bearing, a first sealing ring, a shaft sleeve, a second radial bearing and a second sealing ring. A flange plate is set at the first impurity-discharging opening of the second bin shell, and the covering plate is hinged with the flange plate through a hinge. The sealing gasket is fixedly installed on the flange plate. The locking mechanism comprises a locking screw stem and a locking nut. The locking screw stem is movably installed on the covering plate through a hinge pin. A lock plate is set on the flange plate, and the lock plate is provided with a lock groove, in which the locking screw stem is stuck. The locking nut is screwed on the locking screw stem and pressed against the lock plate, and the covering plate is pressed against the sealing gasket. The bearing seat is fixedly installed on the second bin shell, and the thrust bearing and the first radial bearing are respectively installed in the bearing seat. The middle shaft is inserted in the bearing seat, and a supporting seat is set on the middle shaft located in the bearing seat. The supporting seat is set on the thrust bearing, and the first radial bearing encircles the outside of the supporting seat. The sixth motor is fixedly installed on the bearing seat, and fixedly connected to the supporting seat through the second coupling. The first sealing ring is fixedly stuck in the axis hole of the second bin shell and encircles the outside of the middle shaft. The shaft sleeve is fixedly installed on the second bin shell, and the second rotary shaft is movably inserted in the shaft sleeve through the second radial bearing. The second sealing ring is fixedly stuck in the shaft sleeve and encircles the outside of the second rotary shaft. The seventh motor is fixedly installed on the shaft sleeve, and the seventh motor is drivingly connected with the second rotary shaft through a third coupling.

Through a sixth bearing, the pair of first lickers-in are respectively movably installed in the third bin shell, on which the eighth motor is fixedly installed. First gears are set at one-end portions of the pair of first lickers-in, respectively, and the first gears between the pair of first lickers-in mesh each other. A seventh belt pulley is set at the other end of one of the first lickers-in, and an eighth belt pulley is set on the output shaft of the eighth motor, and is belt-drivingly connected with the seventh belt pulley. The second licker-in is movably installed in the third bin shell through a seventh bearing, and a ninth belt pulley is set at one end of the second licker-in. The ninth motor is fixedly installed on the third bin shell, and a tenth belt pulley is set on the output shaft of the ninth motor, and is belt-drivingly connected with the ninth belt pulley.

The third rotary shaft is movably inserted into the third bin shell through a eighth bearing. One end of the vibrating sieve plate is hinged to the inner wall of the third bin shell through a first pivoting shaft, one end of the connecting rod is hinged to the flying wheel disk through a second pivoting shaft. Other end of the connecting rod is hinged to the vibrating sieve plate through a third pivoting shaft. The tenth motor is fixedly installed on the third bin shell, and is drivingly connected to the third rotary shaft through a fourth coupling. The conveying shaft is movably installed in the conveying trough through a ninth bearing. The eleventh motor is fixedly installed on the third bin shell, and is drivingly connected with the conveying shaft through a fifth coupling.

The third opening roller is movably installed in the third bin shell and the lifting channel through a tenth bearing, respectively. An eleventh belt pulley is set at one end of the adjacent third opening rollers, respectively, and the eleventh belt pulleys between the adjacent third opening rollers are belt-driving connected with each other, respectively. A twelfth belt pulley is set at the other end of one of the third opening rollers. The twelfth motor is fixedly installed on the third bin shell, and a thirteenth belt pulley is set on the output shaft of the twelfth motor, and is belt-drivingly connected with the twelfth belt pulley.

The drum impurity-removal mechanism further comprises a third sealing ring. The third sealing ring is fixedly stuck in the connecting sleeve and encircles the outside of the annular hump. The drum is movably installed in the fourth bin shell through an eleventh bearing, and the thirteenth motor is fixedly installed on the fourth bin shell. A second gear is set at the other end of the drum, and a third gear is set on the output shaft of the thirteenth motor, and meshes with the second gear. The fourth rotary shaft is movably inserted in the discharging pipe through a twelfth bearing, the fourteenth motor is fixedly installed on the discharging pipe, and is drivingly connected with the fourth rotary shaft through a sixth coupling.

The beneficial effects that the invention can achieve by adopting the above technical solutions are that:

1. The opening-impurity-removal mechanism shreds the cotton linters by the first opening roller and the second opening roller, and then uses the stirring rods to disperse the large mass of cotton linters that cannot be sucked away by the wind. The large mass of cotton linters are broken into small mass of cotton linters, which are sucked and discharged from the first discharge opening, so as to improve the opening-cotton efficiency and impurity-removal effect.

2. The gravity impurity-removal mechanism uses the raking rod to rake the cotton linters in the sieving hopper to break up the linters, so that the impurities contained in the cotton linters are scattered, and the sieving hopper is vibrated by the cam to sieve the impurities, which has a good impurity-removal effect.

3. After the drum impurity-removal mechanism removes the cotton linters by the drum, the cotton linters are adsorbed on the arc plate through the fourth induced draft fan, so that the impurities in the cotton linters are discharged through the second mesh, thereby improving the impurity-removal effect.

4. The secondary opening-and-impurity-removal mechanism shreds the cotton linters by the first lickers-in and the second licker-in, and opens the cotton linters by the third opening roller, which has a good opening effect. The cotton linters are vibrated by the vibrating sieve plate, and while the third opening roller is opening and conveying the cotton linters, the impurities in the cotton linters are suck away through the impurity-leaking holes, thereby having a good impurity-removal effect.

DETAILED DESCRIPTION

Figure 1:
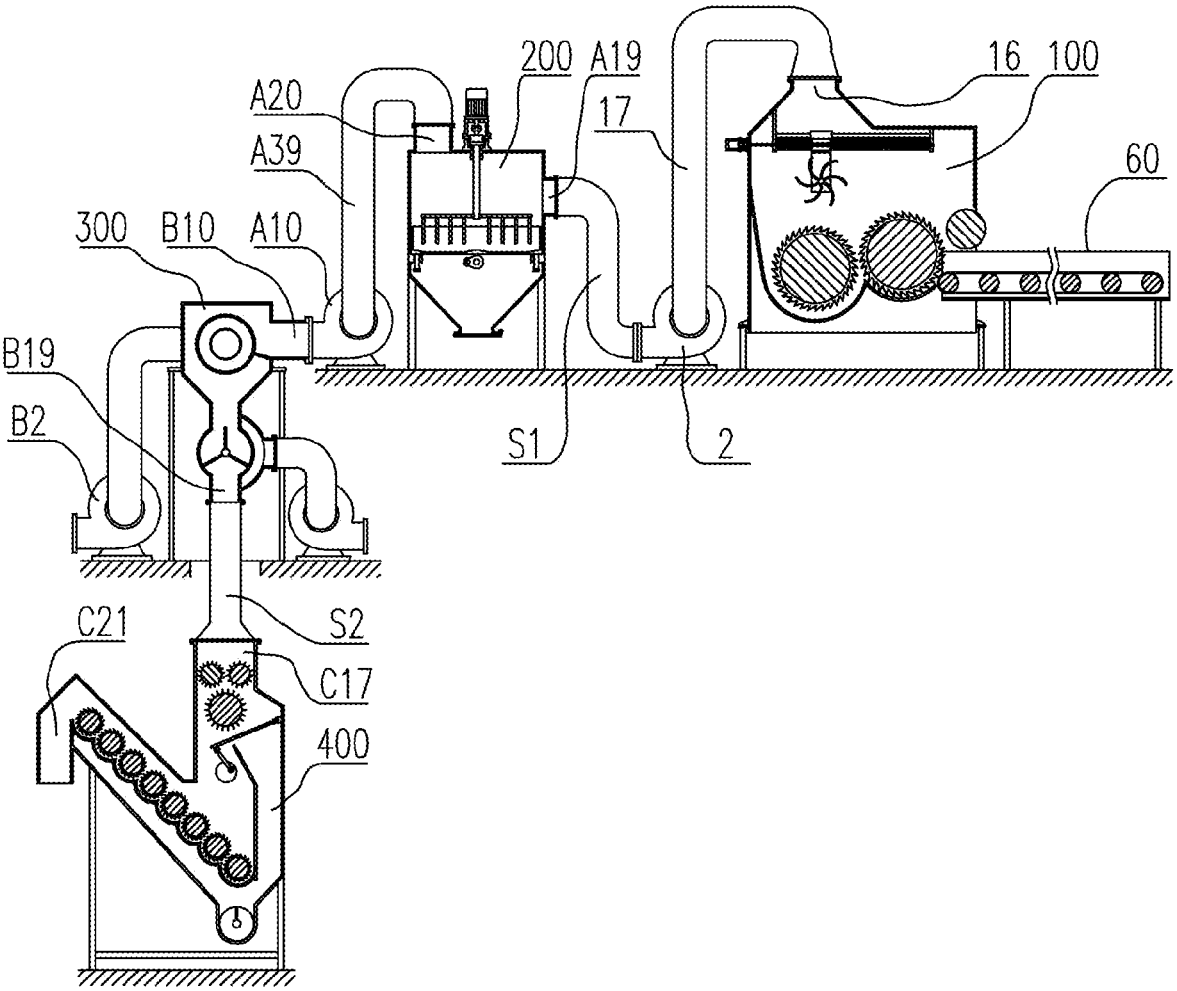
FIG. 1 is a schematic diagram of the invention.
Figure 2:
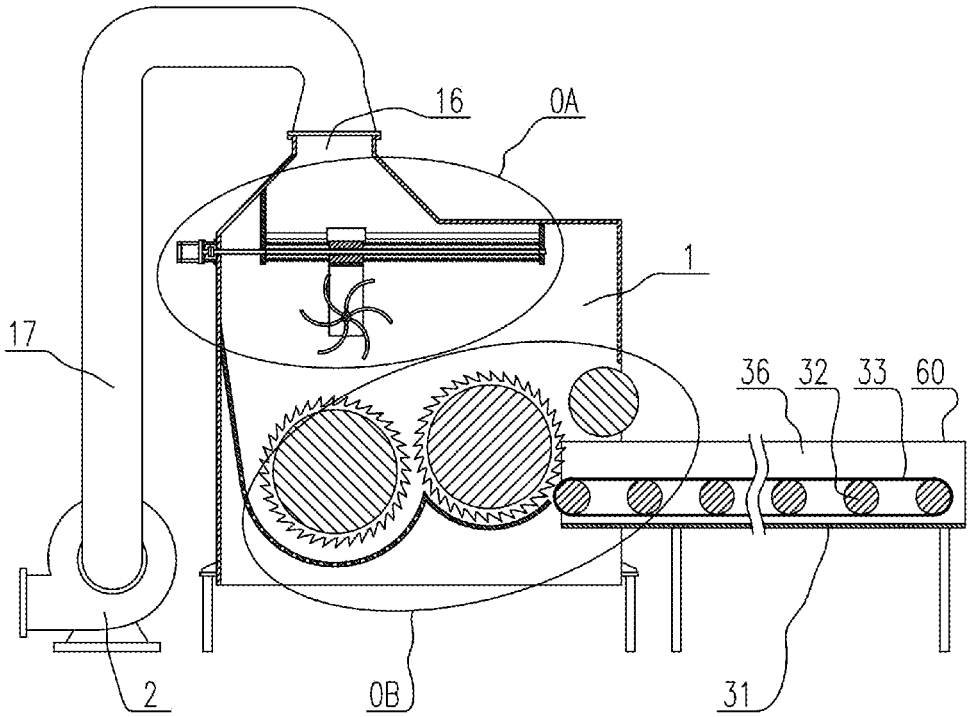
FIG. 2 is a schematic diagram of the opening-and-impurity-removal mechanism.
Figure 3:
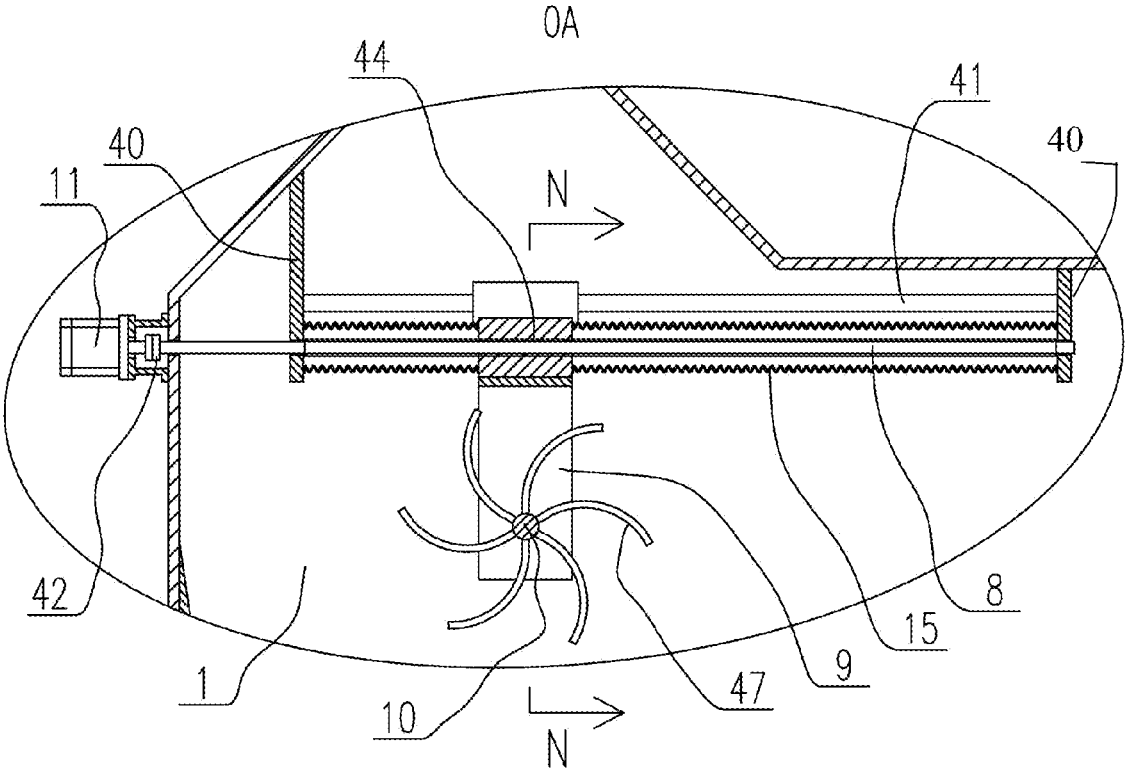
FIG. 3 is a partial enlarged schematic diagram at 0A in FIG. 2.
Figure 4:
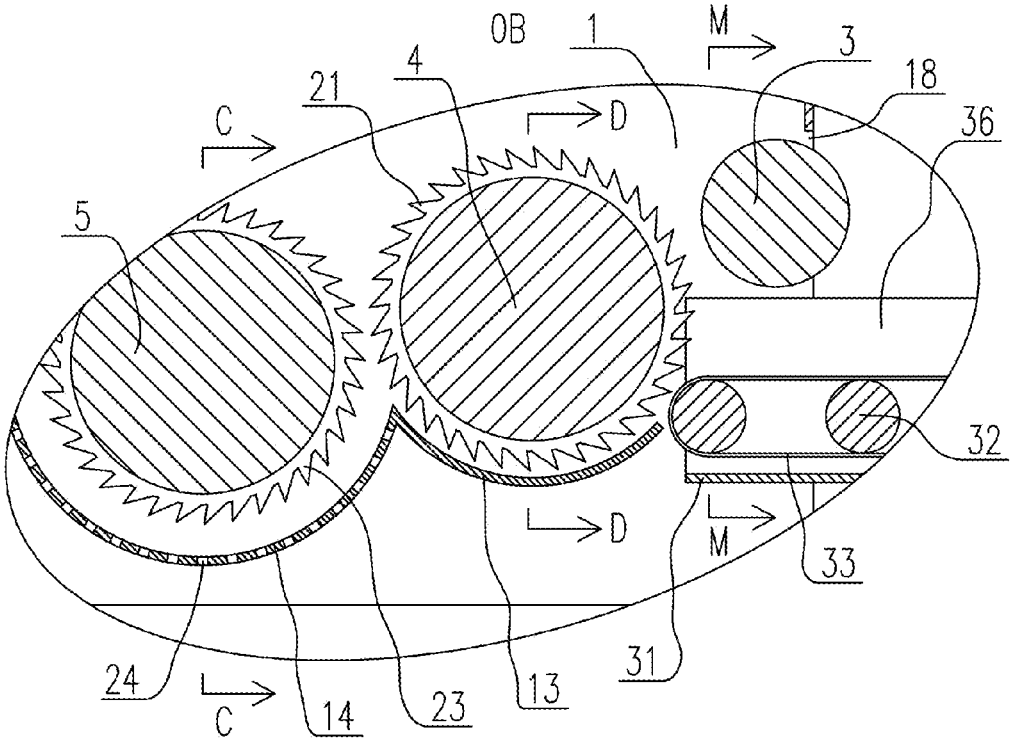
FIG. 4 is a partial enlarged schematic diagram at 0B in FIG. 2.
Figure 5:
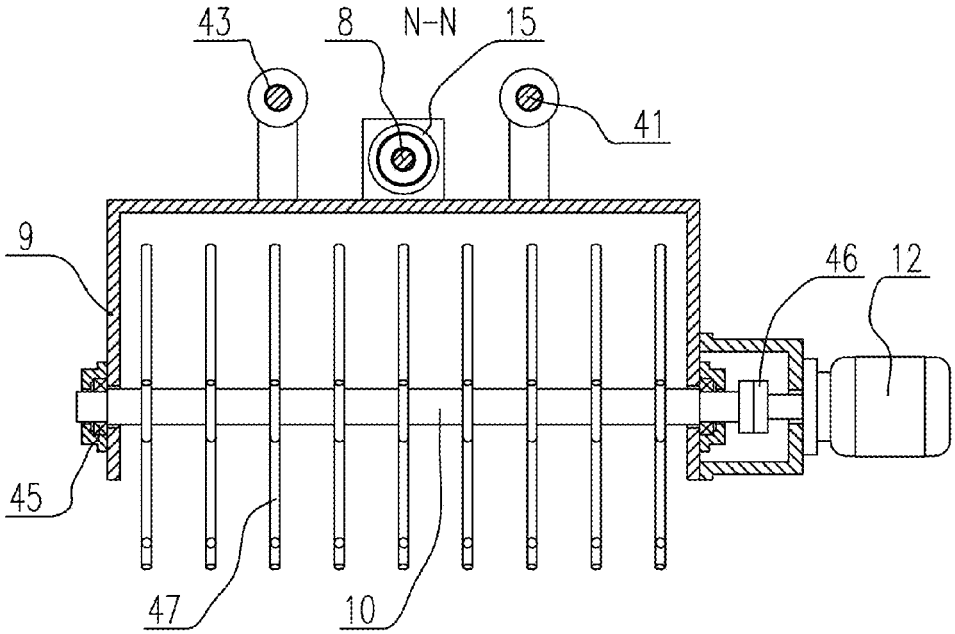
FIG. 5 is a N-N cross-sectional view of FIG. 3.
Figure 6:
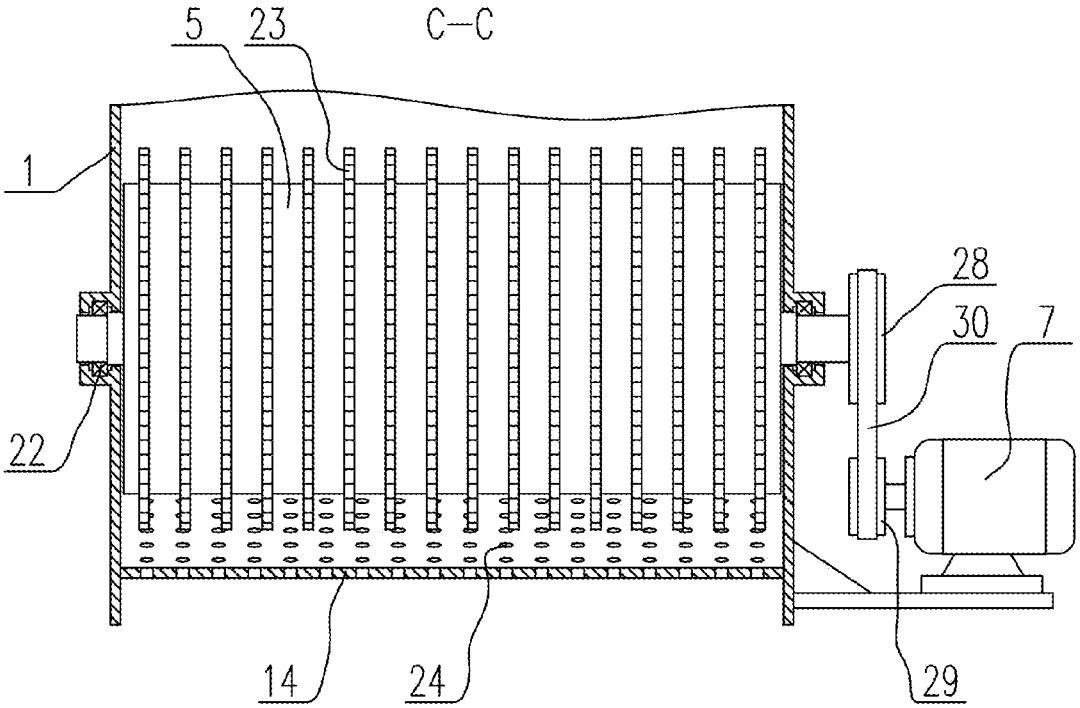
FIG. 6 is a C-C cross-sectional view of FIG. 4.
Figure 7:
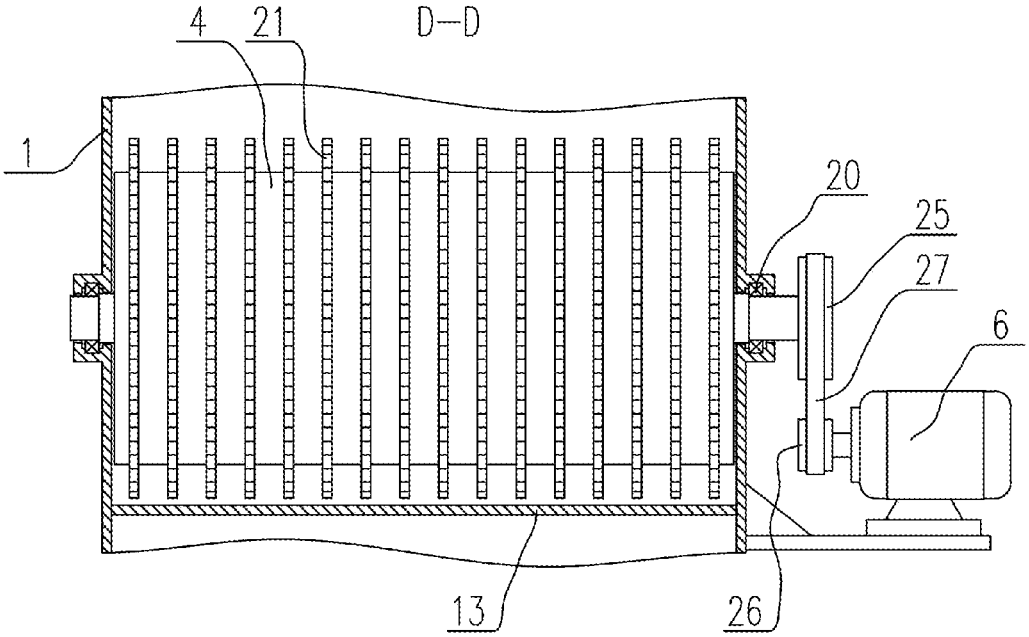
FIG. 7 is a D-D cross-sectional view of FIG. 4.
Figure 8:
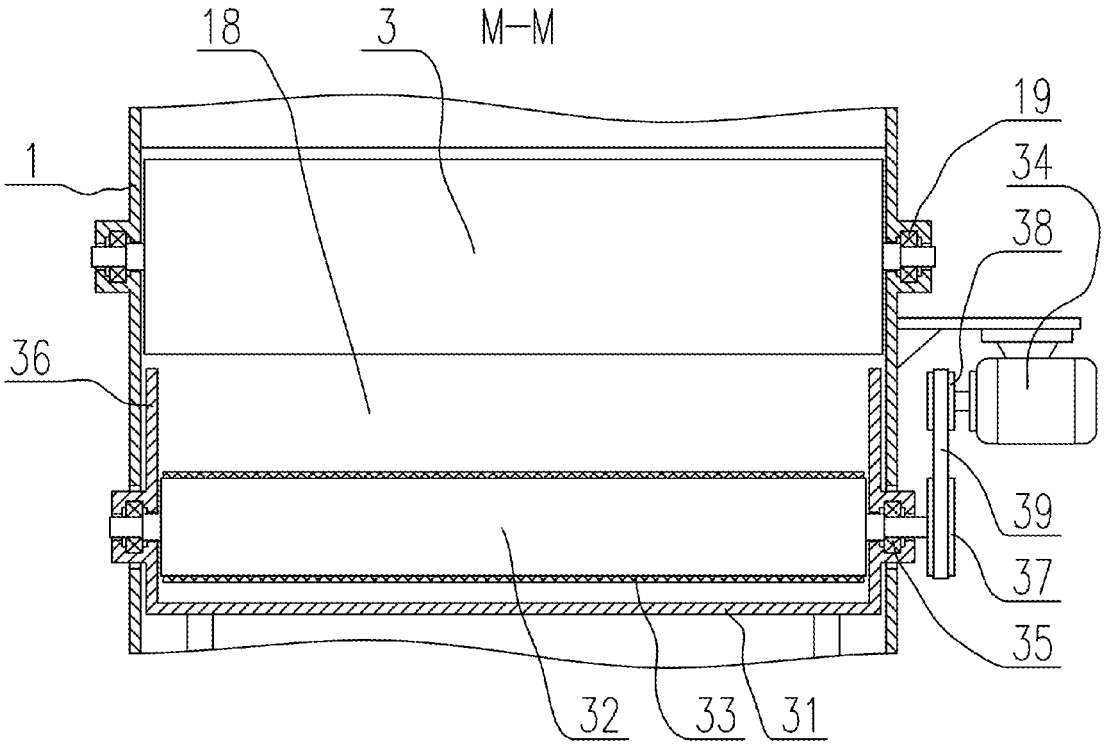
FIG. 8 is a M-M cross-sectional view of FIG. 4.

As shown in FIG. 1, The impurity-removal device for refining cotton comprises an opening-and-impurity-removal mechanism 100, a gravity impurity-removal mechanism 200, a drum impurity-removal mechanism 300 and a secondary opening-and-impurity-removal mechanism 400. The opening-and-impurity-removal mechanism 100 comprises a first bin shell 1, a first induced draft fan 2, a conveying mechanism 60, a pressing roller 3, a first opening roller 4, a second opening roller 5, a first motor 6, a second motor 7, a screw rod 8, a sliding seat 9, a first rotary shaft 10, a third motor 11, a fourth motor 12, a first bottom plate 13, a second bottom plate 14 and a pair of corrugated dust-proof sleeves 15. The bottom of the first bin shell 1 is open, and the top of the first bin shell 1 is provided with a first discharge opening 16, with which the air inlet of the first induced draft fan 2 communicates through a first air duct 17. The front wall of the first bin shell 1 is provided with a first feeding opening 18, from which the rear part of the conveying mechanism 60 penetrates into the first bin shell 1. As shown in FIGS. 4 and 8, the pressuring roller 3 is movably installed on the first feeding opening 18 of the first bin shell 1 through a fourth bearing 19, and located above the conveying mechanism 60. As shown in FIG. 7, The first opening roller 4 is movably installed in the first bin shell 1 through a first bearing 20, located at the rear end of the conveying mechanism 60, and first saw teeth 21 in a row are set on the periphery of the first opening roller 4. The first motor 6 is drivingly connected with the first opening roller 4. As shown in FIG. 6, the second opening roller 5 is movably installed in the first bin shell 1 through a second bearing 22, and second saw teeth 23 in a row are set on the periphery of the second opening roller 5. The second motor 7 is drivingly connected with the second opening roller 5. The first bottom plate 13 and the second bottom plate 14 are respectively fixedly installed in the first bin shell 1 below the first opening roller 4 and the second opening roller 5. The first bottom plate 13 and the second bottom plate 14 respectively present an arc shape corresponding to the first opening roller 4 and the second opening roller 5. An impurity-discharging hole 24 is set on the second bottom plate 14. The first opening roller 4 and the second opening roller 5 are drivingly connected with the first motor 6 and the second motor 7, respectively, as follows. The first motor 6 and the second motor 7 are respectively fixedly installed on the side wall of the first bin shell 1. A first belt pulley 25 is set at one end of the first opening roller 4, and a second belt pulley 26 is set on the output shaft of the first motor 6, and belt-drivingly connected to the first belt pulley 25 with a belt 27. A third belt pulley 28 is set at one end of the second opening roller 5, a fourth belt pulley 29 is set on the output shaft of the second motor 7, and belt-drivingly connected to the third pulley 28 with a belt 30. The conveying mechanism 60 has the following structure. As shown in FIGS. 2 and 8, the conveying mechanism 60 comprises a frame 31, a conveying roller 32, a conveying belt 33 and a fifth motor 34. The conveying rollers 32 are movably installed in a row on the frame 31 through a third bearing 35. A pair of lateral obstructing plates 36 are set on the frame 31, and located on both sides of the conveying roller 32. The conveying belt 33 is wound on the conveying rollers 32 in a row, and a fifth belt pulley 37 is set on the conveying roller 32 at the rearmost end. The fifth motor 34 is fixedly installed on the first bin shell 1, and a sixth belt pulley 38 is set on the output shaft of the fifth motor 34, and is belt-drivingly connected to the fifth belt pulley 37 with a belt 39. As shown in FIGS. 3 and 5, the inner top of the first bin shell 1 is provided with a pair of supporting plates 40, between which a guiding column 41 is set. The third motor 11 is fixedly installed on the outer wall of the first bin shell 1. The screw rod 8 is movably installed on the pair of supporting plates 40, and one end of the screw rod 8 penetrates from the first bin shell 1 and is drivingly connected with the third motor 11 through a first coupling 42. A through hole 43 and a screw hole 44 are set on the sliding seat 9, which movably encircles the guiding column 41 through the through hole 43, and the screw rod 8 is rotationally set in the screw hole 44 of the sliding seat 9. The pair of corrugated dust-proof sleeves 15 respectively encircle the outside of the screw rod 8. One end of the pair of corrugated dust-proof sleeves 15 is fixedly connected with the sliding seat 9, and the other end of the pair of corrugated dust-proof sleeves 15 is fixedly connected with the pair of supporting plates 40. The first rotary shaft 10 is movably installed on the sliding seat 9 through a fifth bearing 45, the fourth motor 12 is fixedly installed on the sliding seat 9, and the fourth motor 12 is drivingly connected to the first rotary shaft 10 with a second coupling 46, and stirring rods 47 in a row are set on the first rotary shaft 10.

Figure 9:
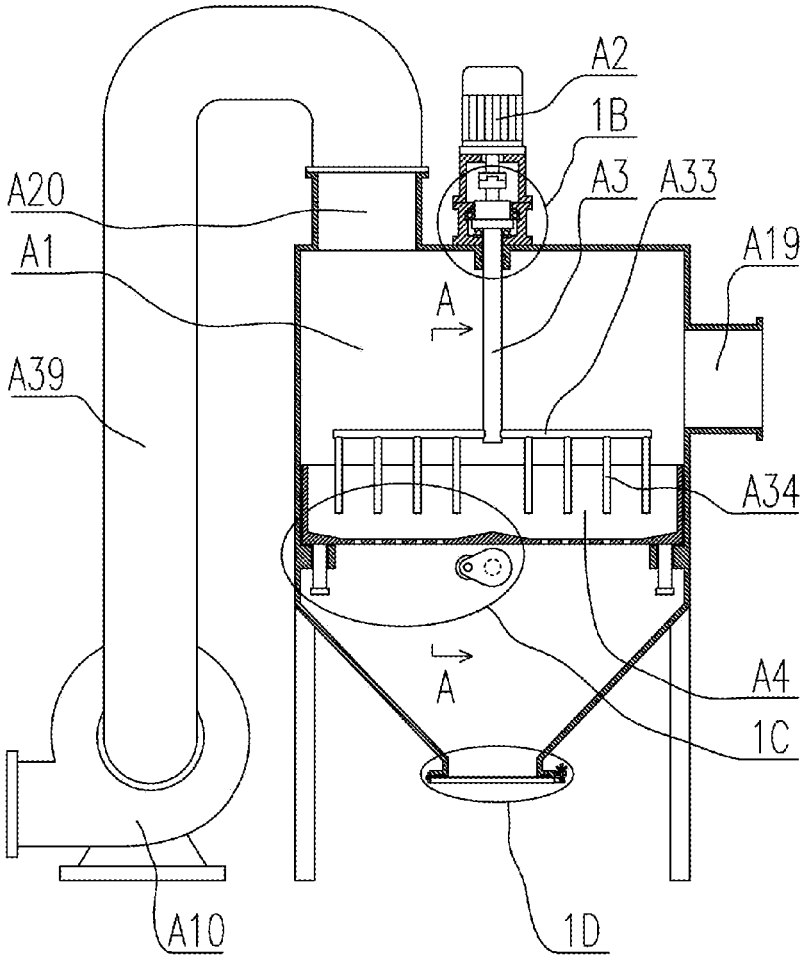
FIG. 9 is a schematic diagram of the gravity impurity-removal mechanism.
Figure 10:
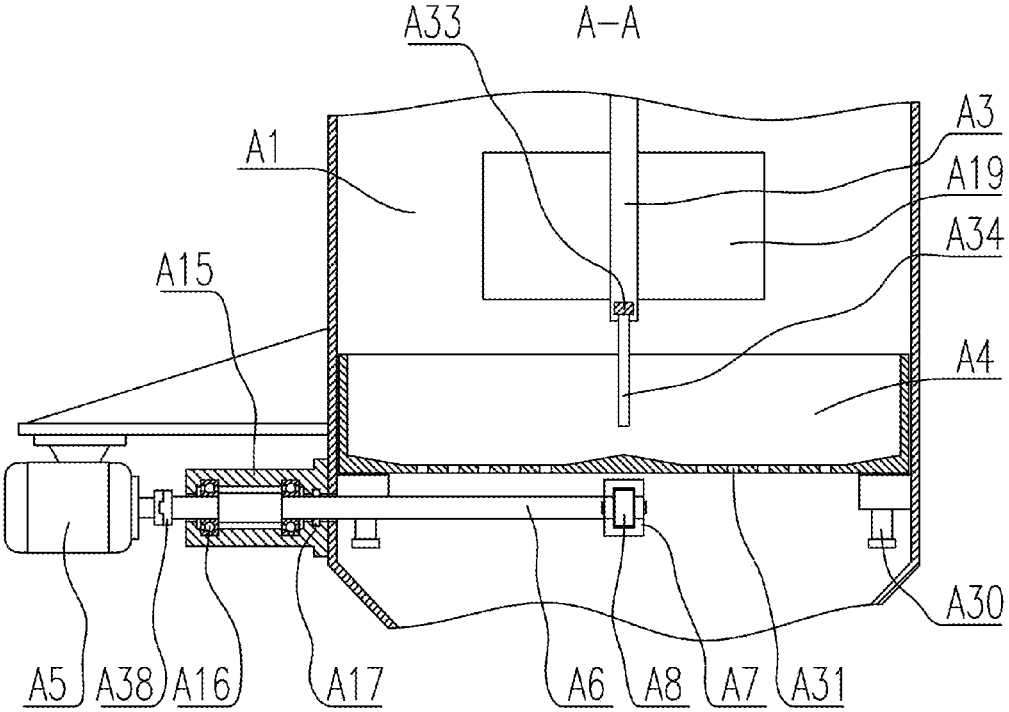
FIG. 10 is an A-A cross-sectional view of FIG. 9.
Figure 11:
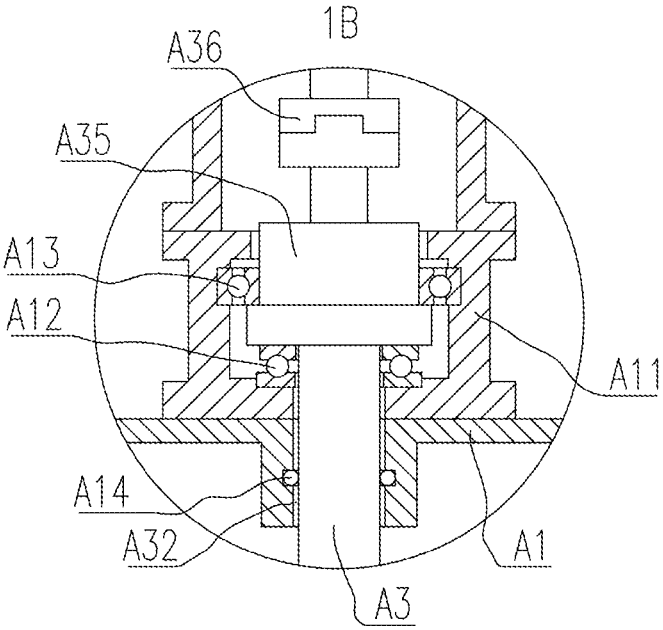
FIG. 11 is a partial enlarged schematic diagram at 1B in FIG. 9.
Figure 12:
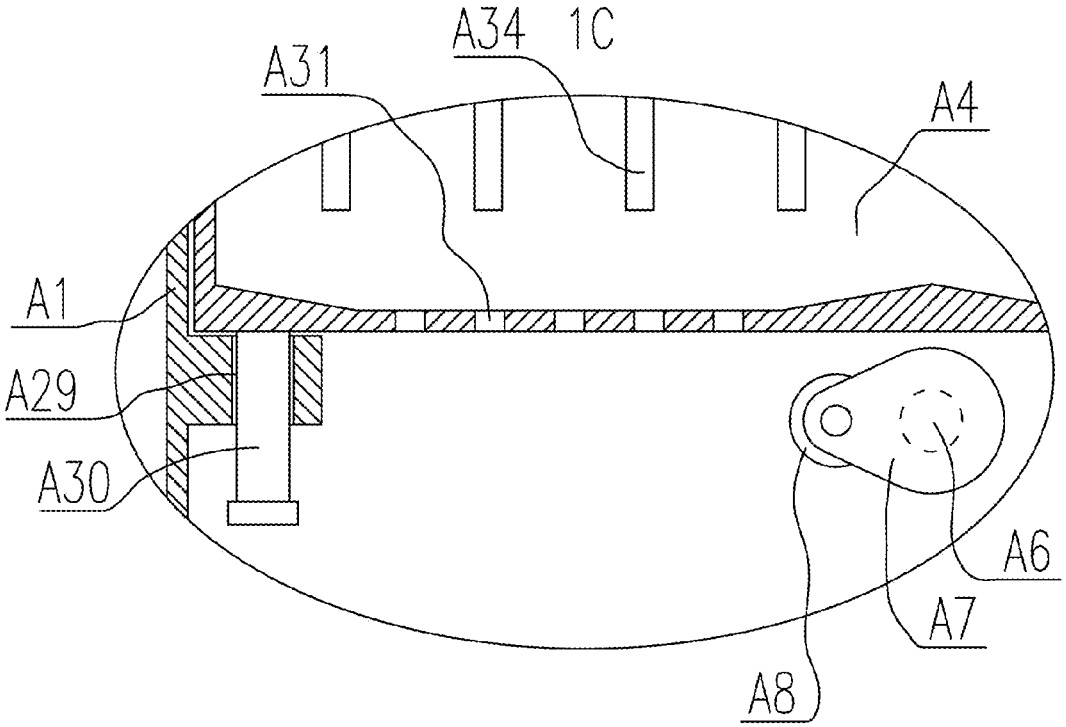
FIG. 12 is a partial enlarged schematic diagram at 1C in FIG. 9.
Figure 13:
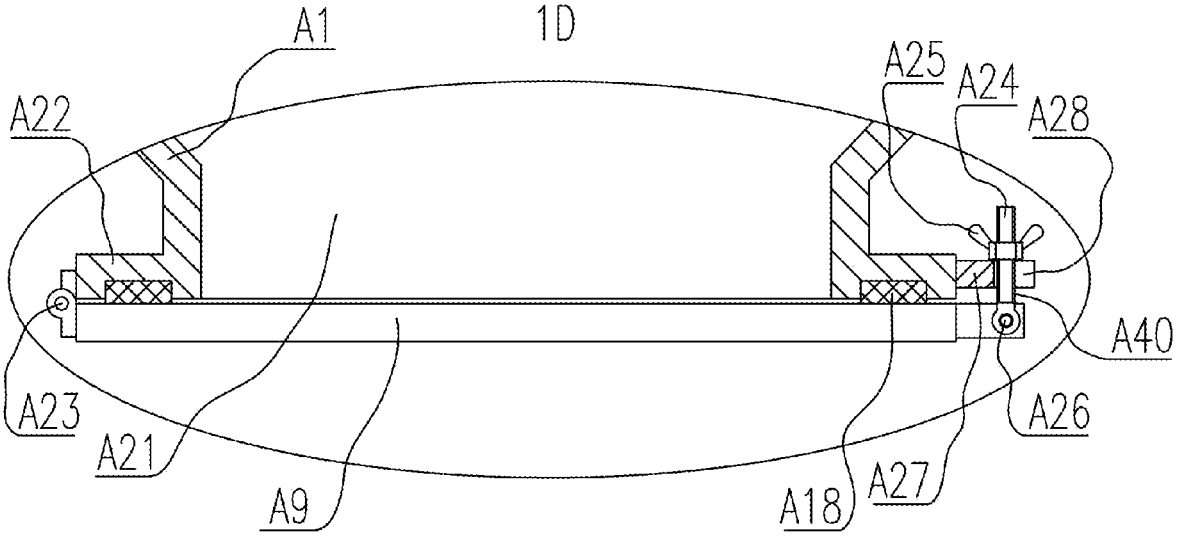
FIG. 13 is a partial enlarged schematic diagram at 1D in FIG. 9.

As shown in FIG. 9, The gravity impurity-removal mechanism 200 comprises a second bin shell A1, a sixth motor A2, a middle shaft A3, a sieving hopper A4, a seventh motor A5, a second rotary shaft A6, a cam A7, a pulley A8, a covering plate A9, a second induced draft fan A10, a bearing seat A11, a thrust bearing A12, a first radial bearing A13, a first sealing ring A14, a shaft sleeve A15, a second radial bearing A16, a second sealing ring A17 and a sealing gasket A18. A second feeding opening A19 is set on the side of the second bin shell A1, the top of which is provided with a second discharging opening A20. The air outlet of the first induced draft fan 2 communicates with the second feeding opening A19 through a first pipe S1, and the air inlet of the second induced draft fan A10 communicates with the second discharging opening A20 through a second air duct A39. The bottom of the second bin shell A1 is provided with a first impurity-discharging opening A21, and the covering plate A9 is hinged and set at first impurity-discharging opening A21 of the second bin shell A1. A locking mechanism A40 is set between the second bin shell A1 and the covering plate A9. The relation between the covering plate A9 and the second bin shell A1, and the specific structure of the locking mechanism A40 are as follows. As shown in FIG. 13, a flange plate A22 is set at the first impurity-discharging opening A21 of the second bin shell A1, and the covering plate A9 is hinged with the flange plate A22 through a hinge A23. The sealing gasket A18 is fixedly installed on the flange plate A22. The locking mechanism A40 comprises a locking screw stem A24 and a locking nut A25. The locking screw stem A24 is movably installed on the covering plate A9 through a hinge pin A26. A lock plate A27 is set on the flange plate A22, and the lock plate A27 is provided with a lock groove A28, in which the locking screw stem A24 is stuck. The locking nut A25 is screwed on the locking screw stem A24 and pressed against the lock plate A27, and the covering plate A9 is pressed against the sealing gasket A18. As shown in FIG. 12, a guiding hole A29 is set on the inner side wall of the second bin shell A1, in which the sieving hopper A4 is located. The bottom of the sieving hopper A4 is provided with a guiding column A30, which is movably inserted in the guiding hole A29. A first sieving holes A31 are set on the bottom wall of the sieving hopper A4, and an axis hole A32 is set on the top wall of the second bin shell A1. The middle shaft A3 is movably inserted into the second bin shell A1 through the axis hole A32, and the sixth motor A2 is drivingly connected to the middle shaft A3. The middle shaft A3 is provided with a transverse rod A33, which is provide with a raking rod A34, and the raking rod A34 extends downward into the sieving hopper A4. The relation between the middle shaft A3 and the second bin shell A1, and the driving relation with the sixth motor A2 are as follows. As shown in FIG. 11, The bearing seat A1 fixedly installed on the second bin shell A1, and the thrust bearing A12 and the first radial bearing A13 are respectively installed in the bearing seat A11. The middle shaft A3 is inserted in the bearing seat A11, and a supporting seat A35 is set on the middle shaft A3 located in the bearing seat A11. The supporting seat A35 is set on the thrust bearing A12, and the first radial bearing A13 encircles the outside of the supporting seat A35. The sixth motor A2 is fixedly installed on the bearing seat A11, and fixedly connected to the supporting seat A35 through the second coupling A36. The first sealing ring A14 is fixedly stuck in the axis hole of the second bin shell A1 and encircles the outside of the middle shaft A3. The second rotary shaft A6 is movably inserted in the second bin shell A1, and the cam A7 is fixedly installed on the second rotary shaft A6. The pulley A8 is movably installed on the cam A7, and the pulley A8 corresponds with the bottom of the sieving hopper A4. The seventh motor A5 is drivingly connected with the second rotary shaft A6. The relation between the second rotary shaft A6 and the second bin shell A1, and the driving relation with the seventh motor A5 are as follows. As shown in FIG. 10, the shaft sleeve A15 is fixedly installed on the second bin shell A1, and the second rotary shaft A6 is movably inserted in the shaft sleeve A15 through the second radial bearing A16. The second sealing ring A17 is fixedly stuck in the shaft sleeve A15 and encircles the outside of the second rotary shaft A6. The seventh motor A5 is fixedly installed on the shaft sleeve A15, and the seventh motor A5 is drivingly connected with the second rotary shaft A6 through a third coupling A38.

Figure 21:
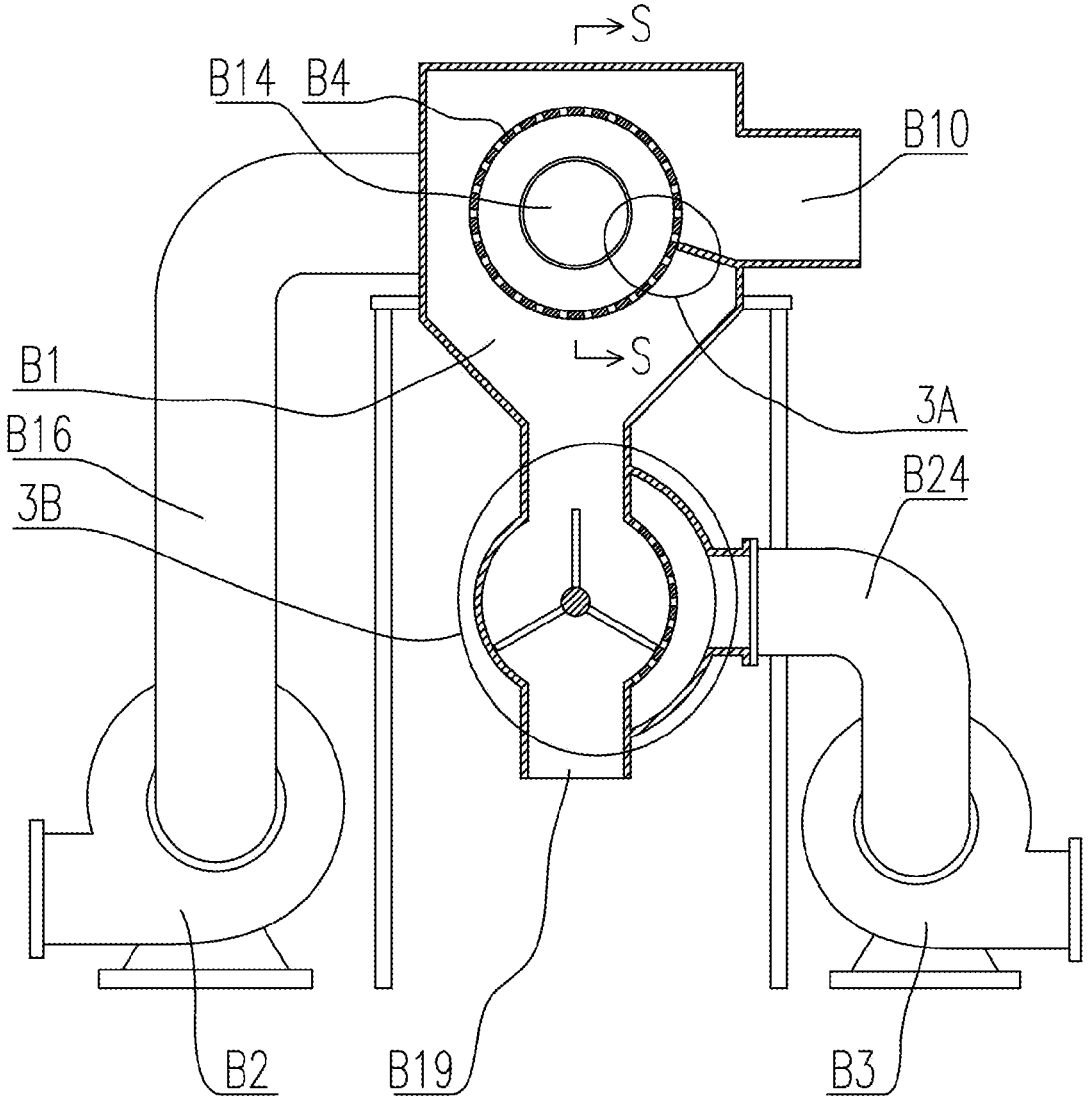
FIG. 21 is a schematic diagram of the drum impurity-removal mechanism.
Figure 22:
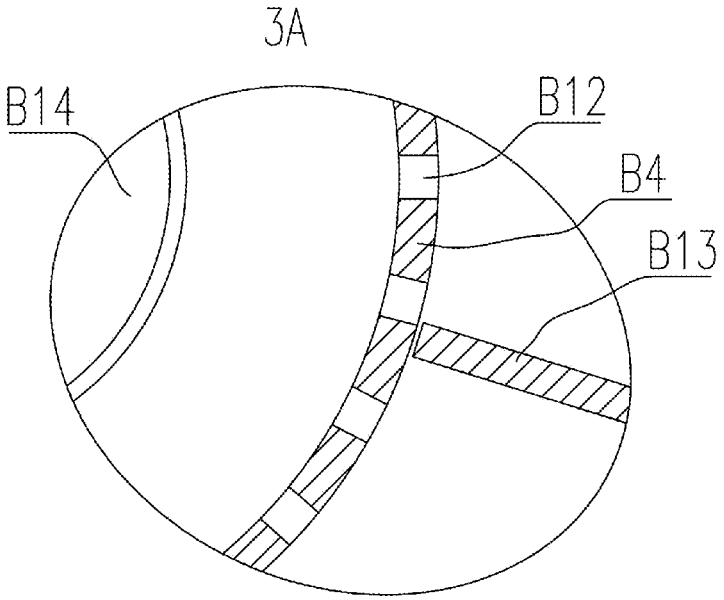
FIG. 22 is a partial enlarged schematic diagram at 3A in FIG. 21.
Figure 23:
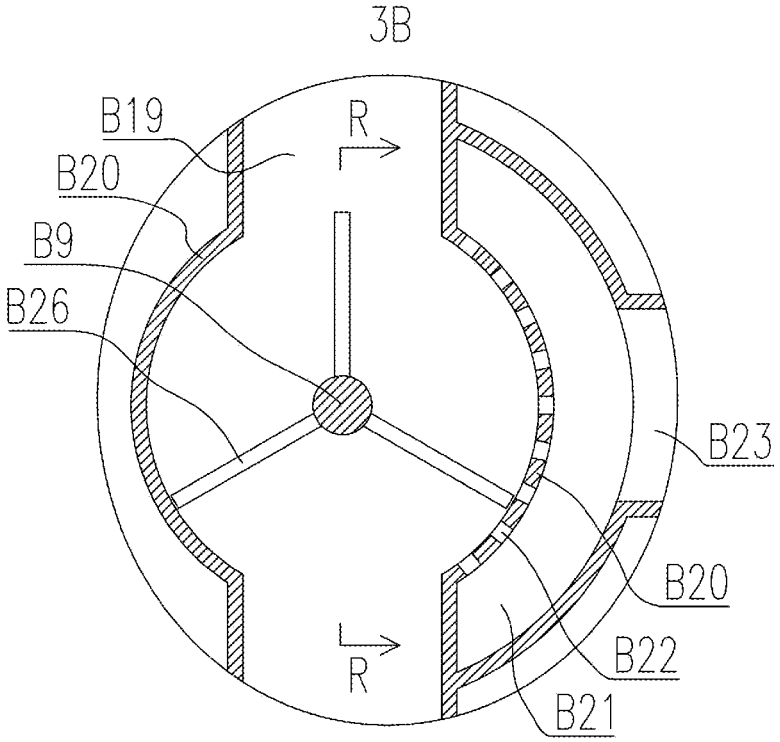
FIG. 23 is a partial enlarged schematic diagram at 3B in FIG. 21.
Figure 24:
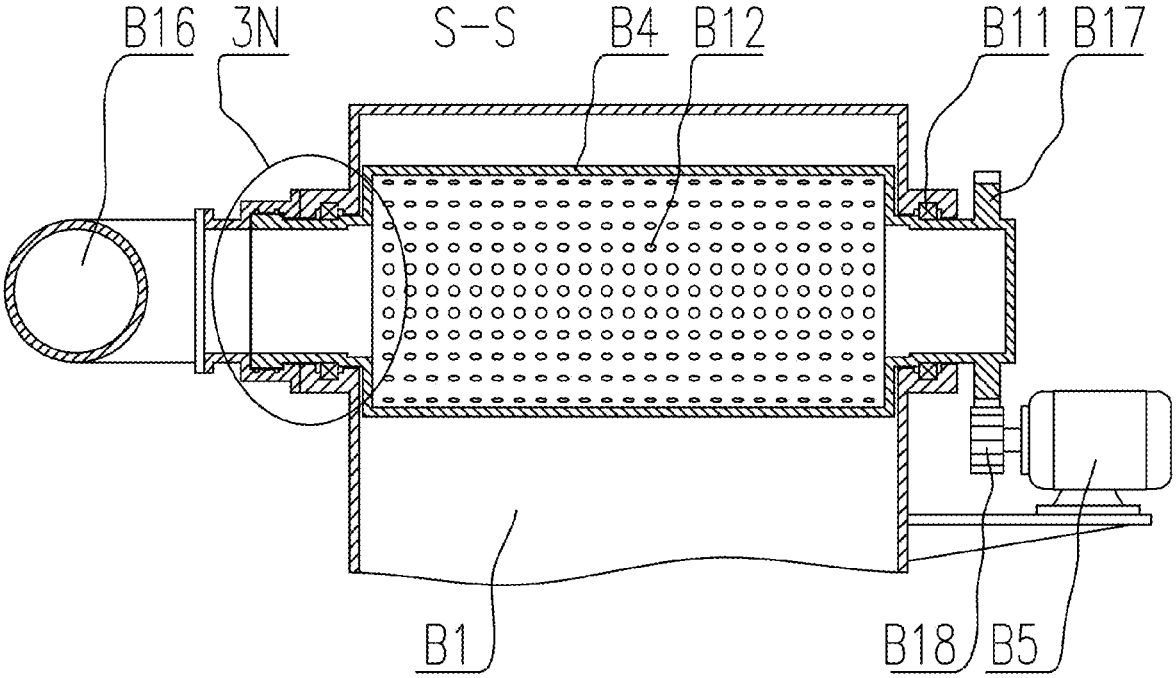
FIG. 24 is a S-S cross-sectional view of FIG. 21.
Figure 25:
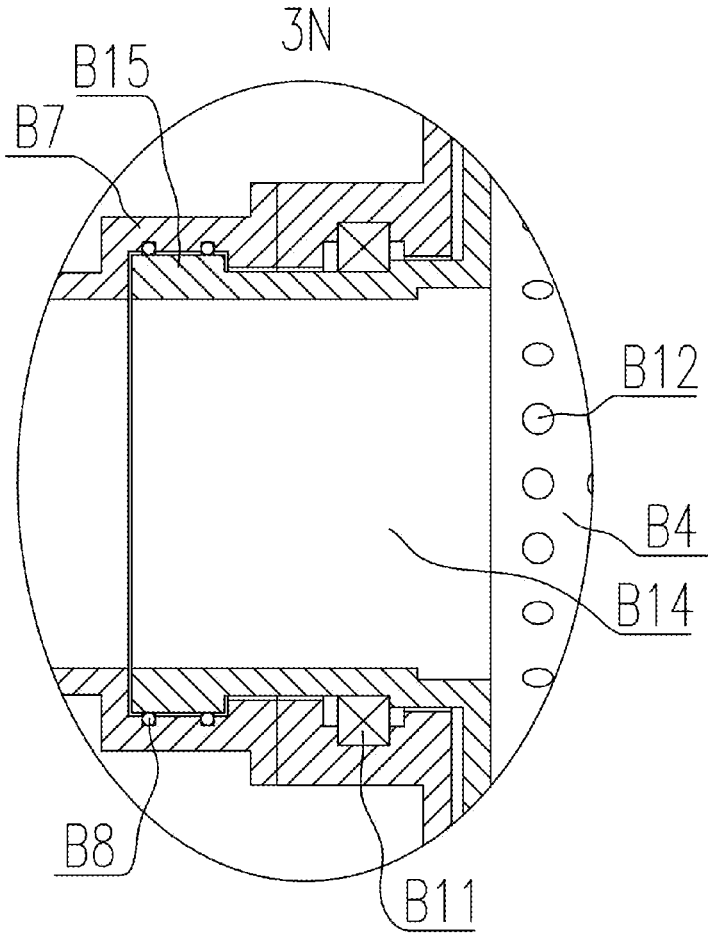
FIG. 25 is a partial enlarged schematic diagram at 3N in FIG. 24.
Figure 26:
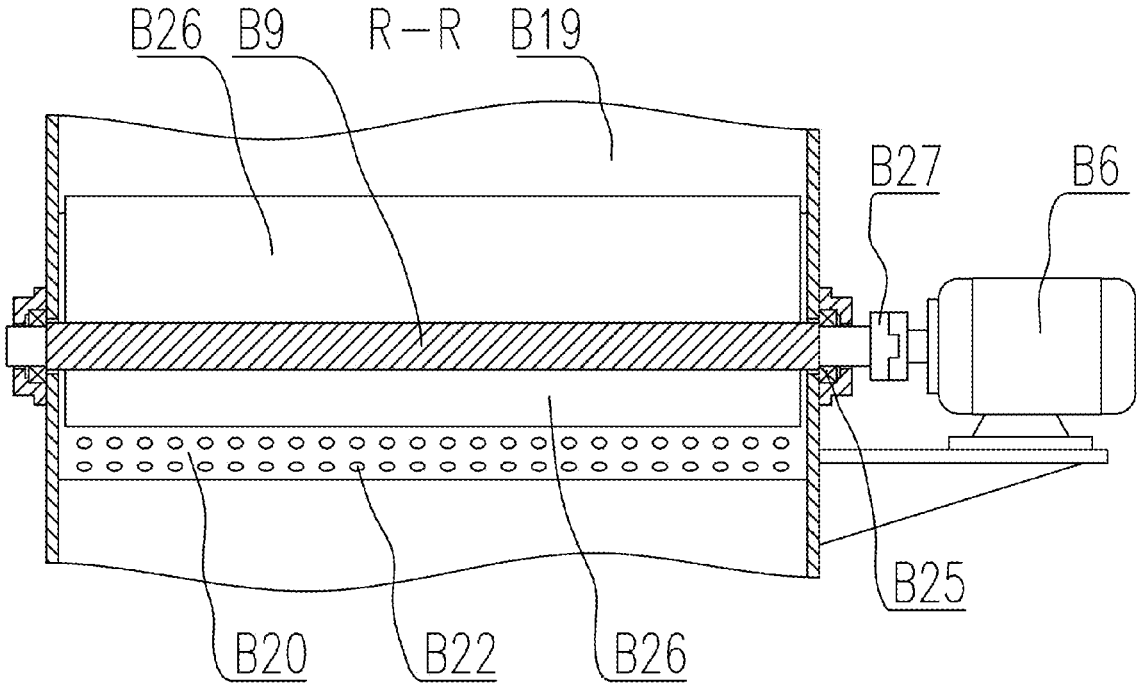
FIG. 26 is a R-R cross-sectional view of FIG. 23.

As shown in FIG. 21, The drum impurity-removal mechanism 300 comprises a fourth bin shell B1, a third induced draft fan B2, a fourth induced draft fan B3, a drum B4, a thirteenth motor B5, a fourteenth motor B6, a connecting sleeve B7, a third sealing ring B8 and a fourth rotary shaft B9. The side part of the fourth bin shell B1 is provided with a fourth feeding opening B10, which the air outlet of the second induced draft fan A10 communicates with. As shown in FIG. 24, the drum B4 is movably installed in the fourth bin shell B1 through a eleven bearing B11, and the drum B4 is tube shaped, and first mesh B12 is set on the peripheral wall of the drum B4. As shown in FIG. 22, a first scraper B13 is set at the fourth feeding opening B10 inside the fourth bin shell B1, opposite the outer peripheral wall of the drum B4. One end of the drum B4 is provided with an impurity-discharging pipe B14, as shown in FIG. 25, the outer periphery of the impurity-discharging pipe B14 is provide with an annular hump B15. The connecting sleeve B7 is fixedly installed on the outer wall of the fourth bin shell B1, and the impurity-discharging pipe B14 is movably stuck in the connecting sleeve B7 through the annular hump B15, and communicates with the connecting sleeve B7. The third sealing ring B8 is fixedly stuck in the connecting sleeve B7 and encircles the outside of the annular hump B15. The third induced draft fan B2 communicates with the connecting sleeve B7 through a third air duct B16, and the thirteenth motor B5 is drivingly connected with the drum B4, as follows. the thirteenth motor B5 is fixedly installed on the fourth bin shell B1. A second gear B17 is set at the other end of the drum B4, and a third gear B18 is set on the output shaft of the thirteenth motor B5, and meshes with the second gear B17. As shown in FIG. 23, the bottom of the fourth bin shell B1 is provided with a discharging pipe B19, the two side walls of which are provided with arc plates B20 having the same centre and the same radius, respectively. An impurity-absorbing cavity B21 is set on the outer side of the arc plate B20 on one side, and second mesh B22 communicating with the impurity-absorbing cavity B21 is set on that arc plate B20, and an impurity-outlet B23 is set on the outer wall of the impurity-absorbing cavity B21. The fourth induced draft fan B3 communicates with the impurity-outlet B23 through a fourth air duct B24. As shown in FIG. 26, the fourth rotary shaft B9 is movably inserted in the discharging pipe B19 through a twelfth bearing B25, and a second scraper B26 is set on the fourth rotary shaft B9, opposite the inner side wall of the arc plate B21. The fourteenth motor B6 is drivingly connected with the fourth shaft B9, as follows. The fourteenth motor B6 is fixedly installed on the discharging pipe B19, and the fourteenth motor B6 is drivingly connected with the fourth rotary shaft B9 through a sixth coupling B27.

Figure 14:
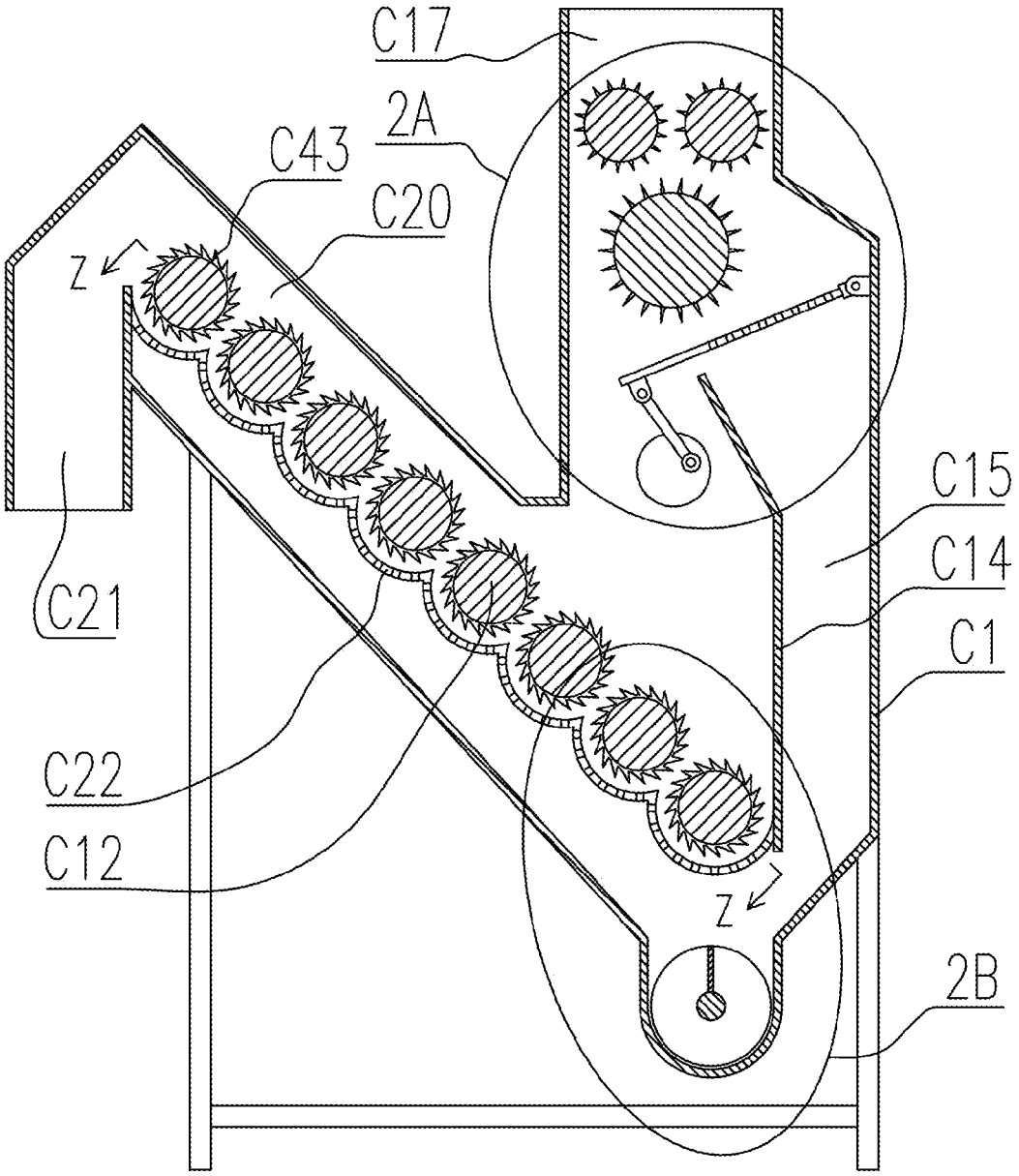
FIG. 14 is a schematic diagram of the secondary opening-and-impurity-removal mechanism.
Figure 15:
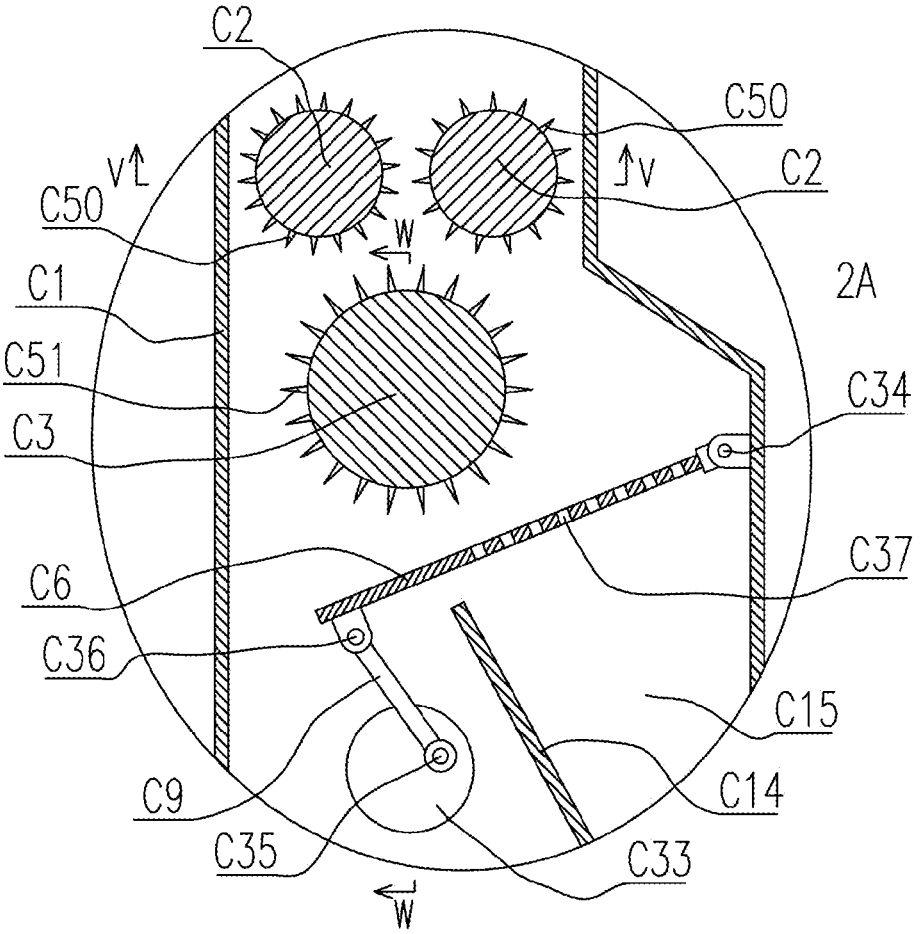
FIG. 15 is a partial enlarged schematic diagram at 2A in FIG. 14.
Figure 16:
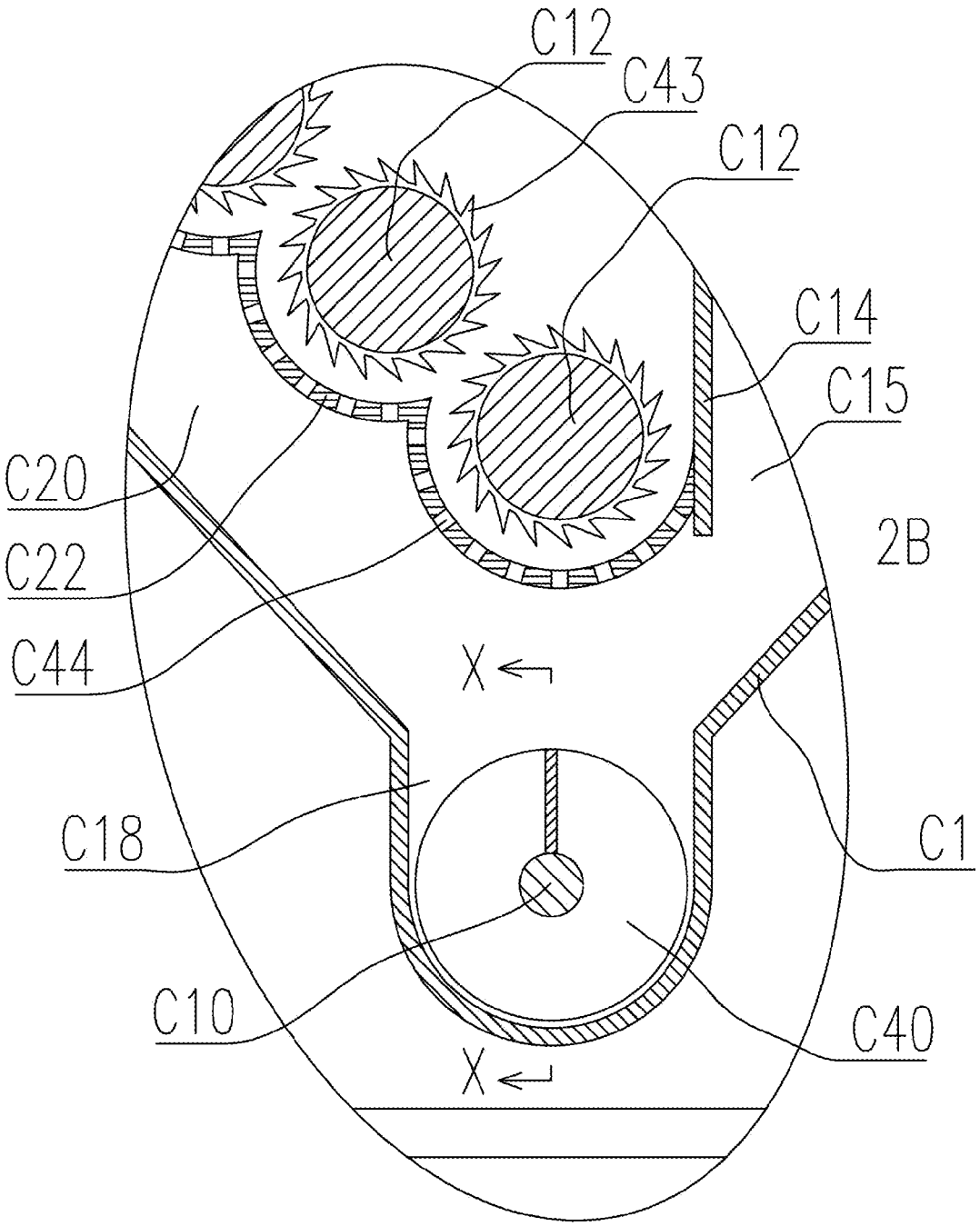
FIG. 16 is a partial enlarged schematic diagram at 2B in FIG. 14.
Figure 17:
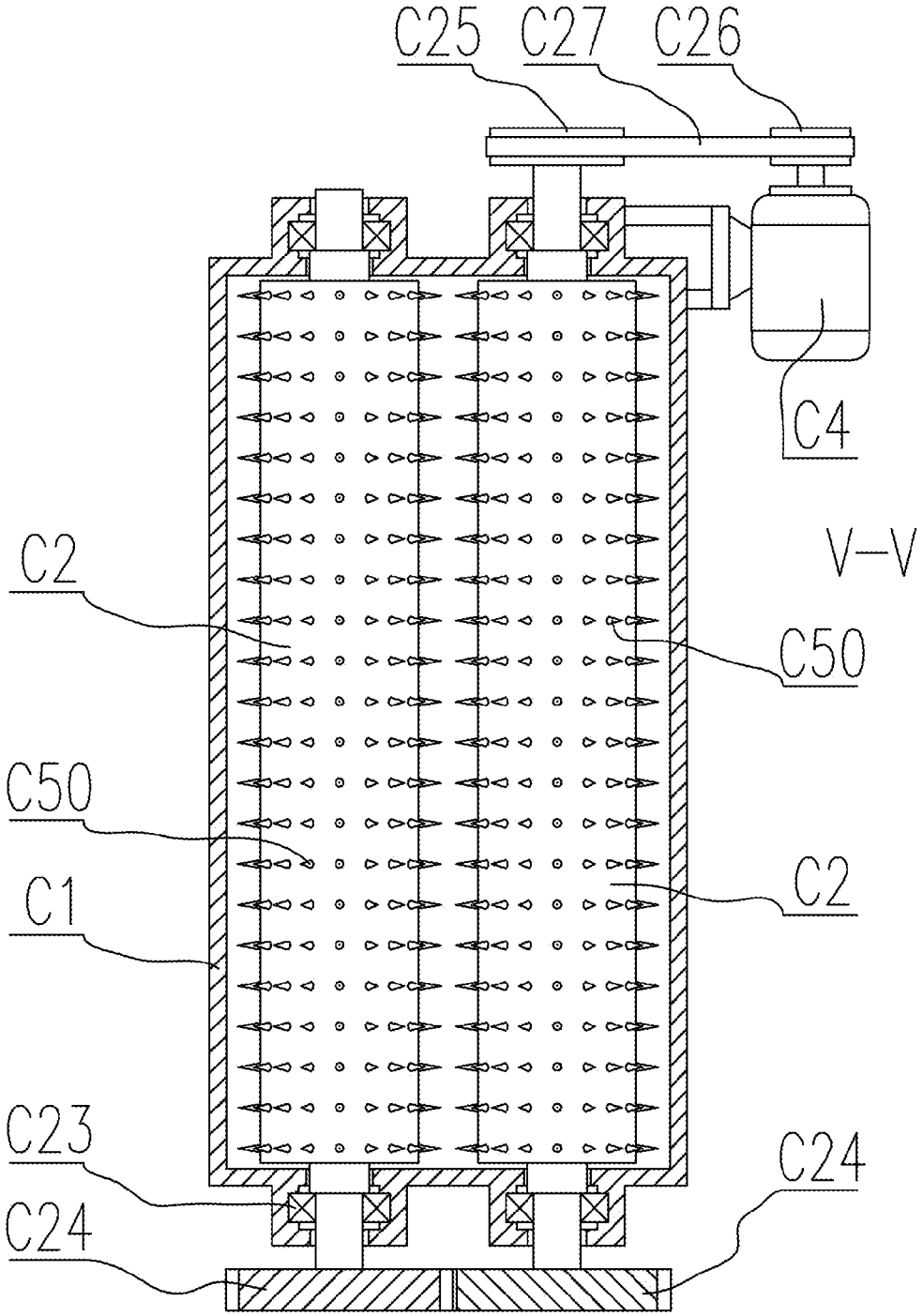
FIG. 17 is a V-V cross-sectional view of FIG. 15.
Figure 18:
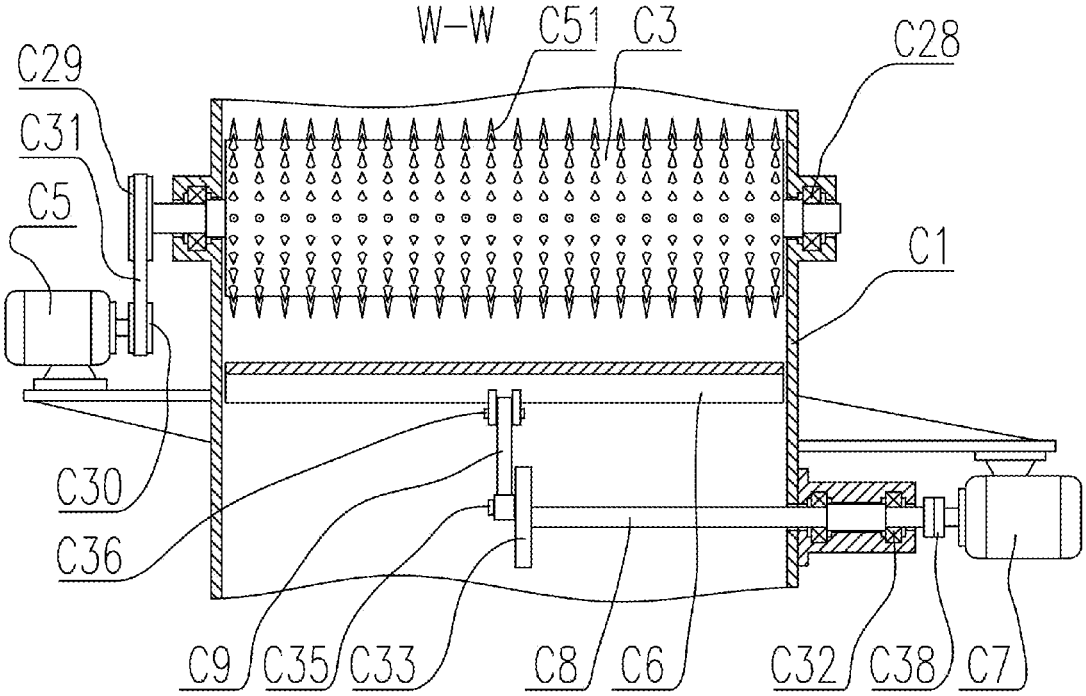
FIG. 18 is a W-W cross-sectional view of FIG. 15.
Figure 19:
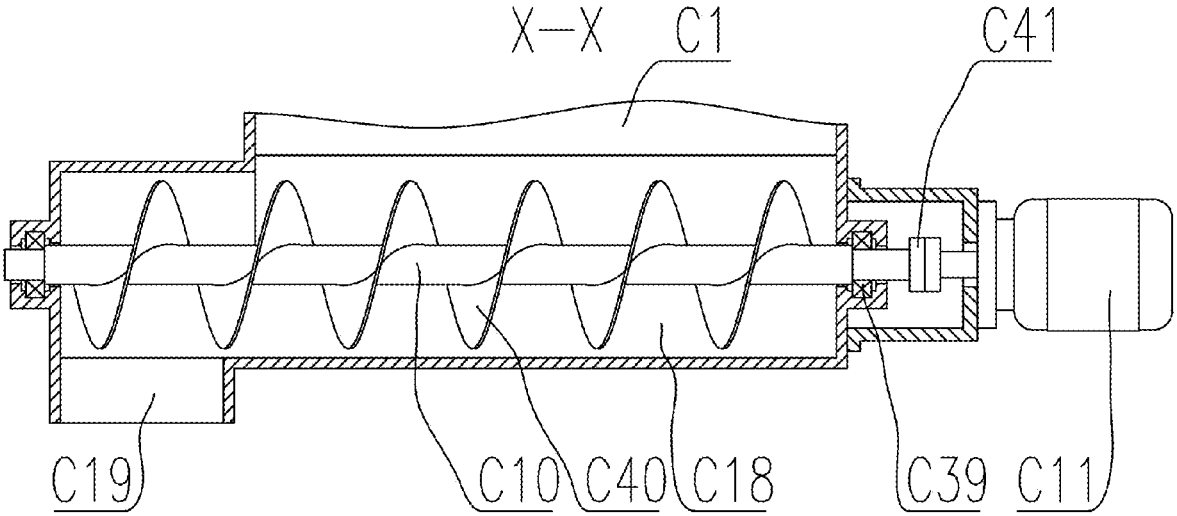
FIG. 19 is a X-X cross-sectional view of FIG. 16.
Figure 20:
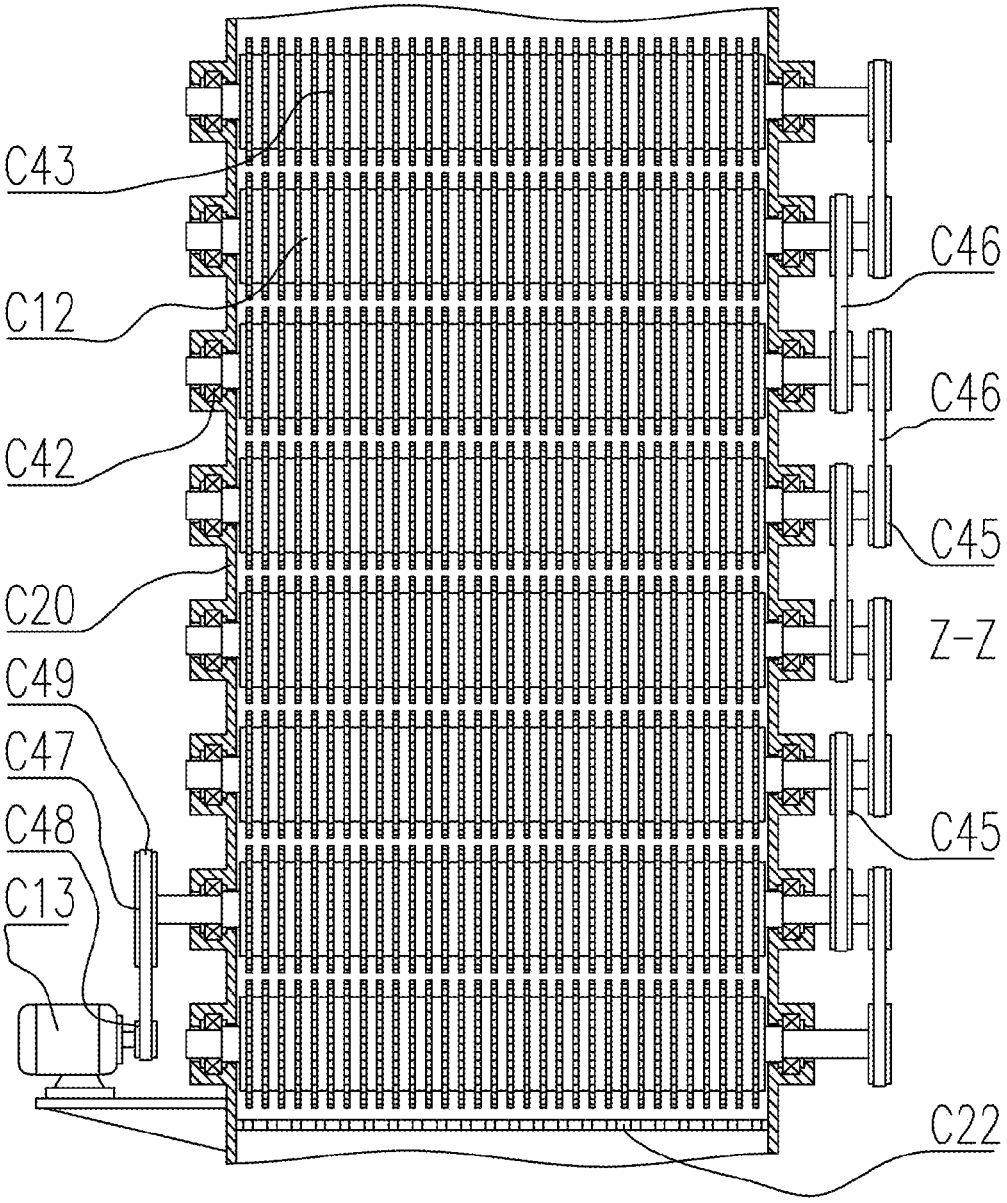
FIG. 20 is a Z-Z cross-sectional view of FIG. 14.

As shown in FIGS. 14, 15 and 16, The secondary opening-and-impurity-removal mechanism 400 comprises a third bin shell C1, a pair of first lickers-in C2, a second licker-in C3, an eighth motor C4, a ninth motor C5, a vibrating sieve plate C6, a tenth motor C7, a third rotary shaft C8, a connecting rod C9, a conveying shaft C10, an eleventh motor C11, a third opening roller C12 and a twelfth motor C13. A third feeding opening C17 is set on the top of the third bin shell C1, and the discharging pipe B19 is connected to the third feeding opening C17 through a second pipe S2. A division plate C14 is set in the third bin shell C1, and an impurity-discharging channel C15 is formed between the division plate C14 and the inner wall of one side of the third bin shell C1. The bottom of the third bin shell C1 is provided with a conveying trough C18, at the bottom of which a second impurity-discharging opening C19 is set. A lifting channel C20 communicating with the inside of the third bin shell C1 is set on the side of the third bin shell C1, and a third discharging opening C21 is set at the upper end of the lifting channel C20. An impurity-leaking plate C22 is set in the third bin shell C1 and the lifting channel C20, and the two ends of the impurity-leaking plate C22 are fixed at the division plate C14 and the third discharging opening C21 of the lifting channel C20, respectively. Through a sixth bearing C23, the pair of first lickers-in C2 are respectively movably installed at the third feeding opening C17 of the third bin shell C1. The periphery of the first lickers-in C2 is provide with a first spike C50, and the eighth motor C4 is drivingly connected with the pair of first lickers-in C2, as follows. As shown in FIG. 17, the eighth motor C4 is fixedly installed on the third bin shell C1. First gears C24 are set at one-end portions of the pair of first lickers-in C2, respectively, and the first gears C24 between the pair of first lickers-in C2 mesh each other. A seventh belt pulley C25 is set at the other end of one of the first lickers-in C2, and an eighth belt pulley C26 is set on the output shaft of the eighth motor C4, and the eighth belt pulley C26 is belt-drivingly connected to the seventh belt pulley C25 with a belt C27. The second licker-in C3 is movably installed in the third bin shell C1 below the pair of the first lickers-in C2 through a seventh bearing C28, a second spike C51 is set on the periphery of the second licker-in C3, and the ninth motor C5 is drivingly connected with the second licker-in C3, as follows. As shown in FIG. 18, a ninth belt pulley C29 is set at one end of the second licker-in C3. The ninth motor C5 is fixedly installed on the third bin shell C1, and a tenth belt pulley C30 is set on the output shaft of the ninth motor C5, and the tenth belt pulley C30 is belt-drivingly connected to the ninth belt pulley C29 with a belt C31. As shown in FIGS. 15 and 18, the third rotary shaft C8 is movably inserted in the third bin shell C1 through a eighth bearing C32, and a flying wheel disk C33 is set on the third rotary shaft C8. One end of the vibrating sieve plate C6 is hinged to the inner wall of the third bin shell C1 through a first pivoting shaft C34, one end of the connecting rod C9 is hinged to the flying wheel disk C33 through a second pivoting shaft C35, and the other end of the connecting rod C9 is hinged to the other end of the vibrating sieve plate C6 through a third pivoting shaft C36. The vibrating sieve plate C6 is located above the impurity-discharging channel C15 and below the second licker-in C3. A second sieving holes C37 are set on the vibrating sieve plate C6, and the tenth motor C7 is fixedly installed on the third bin shell C1, and drivingly connected with the third rotary shaft C8 through a ninth coupling C38. As shown in FIG. 9, the conveying shaft C10 is movably installed in the conveying trough C18 through a ninth bearing C39, and a spiral rib plate C40 is set on the conveying shaft C10, and the eleventh motor C11 is fixedly installed on the third bin shell C1, and drivingly connected to the conveying shaft C10 through a fifth coupling C41. The third opening roller C12 is movably installed in the third bin shell C1 and the lifting channel C20 with an incline through a ninth bearing C42, respectively, and third saw teeth C43 are set on the periphery of the third opening roller C12, respectively. The impurity-leaking plate C22 is located below the third opening roller C12, and the impurity-leaking plate C22 presents a continuous arc corresponding to the third opening rollers C12 in a row, one to one. Impurity-leaking holes C44 are set on the impurity-leaking plate C22, and the twelfth motor C13 is in drivingly connected with the third opening rollers C12 in a row, as follows. As shown in FIG. 20, An eleventh belt pulley C45 is set at one end of the adjacent third opening rollers C12, respectively, and the eleventh belt pulley C45 between the adjacent third opening rollers C12 are belt-driving connected to each other with a belt C46, respectively. A twelfth belt pulley C47 is set at the other end of one of the third opening rollers C12. The twelfth motor C13 is fixedly installed on the third bin shell C1, and a thirteenth belt pulley C48 is set on the output shaft of the twelfth motor C13, and is belt-drivingly connected to the twelfth belt pulley C47 with a belt C49.

The following part shows how the impurity-removal system for refining cotton operates. The compressed slab-shaped cotton linters are placed on the conveying belt 33 of the opening-and-impurity-removal mechanism 100, then the fifth motor 34 drives the conveying roller 32 to rotate. The conveying belt 33 is driven by the conveying roller 32 to convey the cotton linters to the first feeding opening 18 of the first bin shell 1, and is tightly pressed by the pressing roller 3. The first opening roller 4 is driven by the first motor 6 to rotate counterclockwise in FIG. 2, and the second opening roller 5 is driven by the second motor 7 to rotate clockwise in FIG. 2. The cotton linters are shredded by the first saw teeth 21 on the first opening roller 4, and the shredded cotton linters are sent into the first bin shell 1. Then the cotton linters entering the first bin shell 1 are shredded by the second saw teeth 23 on the second opening roller 5, from the original compressed slab-shaped cotton linters into loose cotton lumps. Further, the loose cotton lumps are sucked by the first induced draft fan 2 and discharged from the first discharging opening 16, and the impurities contained in the cotton linters are scattered and removed from the impurity-discharging hole 24 of the first bottom plate 14 during the shredding process. The screw rod 8 is driven to rotate by the third motor 11, and drives the sliding seat 9 to move back and forth along the guiding column 41, at the same time, the first rotary shaft 10 is driven to rotate clockwise in FIG. 2 by the fourth motor 12. The large masses of cotton linters that cannot be sucked away by the wind in the first bin shell 1 are dispersed by the stirring rod 47 on the first rotary shaft 10 from large mass into small mass, then the small masses of cotton linters are sucked away from the first discharging opening 16. The cotton linters are opened and purified in the opening-and-impurity-removal mechanism 100 and then enter the second bin shell A1 of the gravity impurity-removal mechanism 200 from the second feeding opening A19. Some lighter loose cotton linters is sucked by the second induced draft fan A10, and discharged from the second discharging opening A20, and the heavier impurities fall into the sieving hopper A4. The seventh motor A5 drives the second rotary shaft A6 to rotate, and the sieving hopper A4 is vibrated by the cam A7, so that impurities fall into the lower part of the second bin shell A1 from the first sieving holes A31 of the sieving hopper A4. Some of the cotton linters entering the second bin shell A1 from the second feeding opening A19 is still agglomerated together, and cannot be sucked directly from the second discharging opening A20 with heavy weight, so they fall into the sieving hopper A4. The sixth motor A2 drives the middle shaft A3 to rotate, and the cotton linters in the sieving hopper A4 are raked by the raking rod A34 to break up the cotton linters, so that the impurities mixed in the cotton linters are scattered. After having been scattered, the cotton linters become lighter and are sucked away from the second discharging opening A20 by the second induced draft fan A10, and the impurities fall from the first sieving holes A31 of the sieving hopper A4. When a lot of impurities exist in the lower part of the second bin shell A1, then they can be cleaned up by loosening the locking nut A25 and opening the covering plate A9. After the cotton linters are purified by gravity in the gravity impurity-removal mechanism 200, then they enter the fourth bin shell B1 of the drum impurity-removal mechanism 300 from the fourth feeding opening B10. The cotton linters are adsorbed on the outer peripheral wall of the drum B4 by the third induced draft fan B2, and the impurities in the cotton linters are sucked into the drum B4 through the first mesh B12 and discharged from the drum B4 through the impurity-discharging pipe B14. The thirteenth motor B5 drives the B4 to rotate counterclockwise in FIG. 21, during rotation, the cotton linters absorbed on the outer peripheral wall of the drum B4 is scraped off by the first scraper B13 and dropped into the discharging pipe B19. The fourteenth motor B6 drives the fourth rotary shaft B9 to rotate clockwise in FIG. 21, and the second scraper B26 pushes the cotton linters to one side of the arc plate B20 with the second mesh B22. The cotton linters are adsorbed on the arc plate B20 by the fourth induced draft fan B3, and the impurities in the cotton linters are sucked into the impurity-absorbing cavity B21 through the second mesh B22, and discharged from impurity-outlet B23. Then, while the second scraper B26 continues rotating, the cotton linters absorbed on the arc plate B20 are scraped off and discharged from the discharging pipe B19, and discharged from the third feeding opening C17 into the third bin shell C1 of the secondary opening-and-impurity-removal mechanism 400. The pair of first lickers-in C2 are driven to rotate by the eighth motor C4, as shown in FIG. 14, the first licker-in C2 on the left side in the pair of first lickers-in C2 rotates clockwise. The first spike C50 on the pair of first lickers-in C2 shreds the cotton linters, then the second licker-in C3 is driven to rotate by the ninth motor C5, as shown in FIG. 14, the second licker-in C3 rotates clockwise. The cotton linters are shredded by the second spike C51 on the second licker-in C3, and then the cotton linters fall onto the vibrating sieve plate C6. The third rotary shaft C8 is driven to rotate by the tenth motor C7, and drives the vibrating sieve plate C6 to vibrate by the connecting rod C9, during the vibrating process, some impurities in the cotton linters fall from the second sieving holes C37 to the impurity-removal channel C15, and fall into the conveying trough C18 through the impurity-removal channel C15. The cotton linters after being vibrated fall into the third bin shell C1 below the vibrating sieve plate C6, and the third opening roller C12 in a row is driven to rotate by the twelfth motor C13, as shown in FIG. 14, the third opening roller C12 rotates counter-clockwise. The cotton linters are opened and conveyed by the third saw teeth C43 on the third opening roller C12 in a row, so that the cotton linters are discharged from the third discharging opening C21 of the lifting channel C20. During the opening and conveying process, the impurities in the cotton linters are scattered, and fall into the bottom of the lifting channel C20 through the impurity-leaking hole C44, and slide down into the conveying trough C18. The conveying shaft C10 is driven to rotate by the eleventh motor C11, and the impurities in the conveying trough C18 are conveyed through the spiral rib plate C40 on the conveying shaft C10 and discharged from the second impurity-discharging opening C19.

What is claimed is:

1. An impurity removal system for refining cotton, comprising an opening-and-impurity-removal mechanism (100), a gravity impurity-removal mechanism (200), a drum impurity-removal mechanism (300) and a secondary opening-and-impurity-removal mechanism (400), wherein, the opening-and-impurity-removal mechanism (100) comprises a first bin shell (1), a first induced draft fan (2), a conveying mechanism (60), a pressing roller (3), a first opening roller (4), a second opening roller (5), a first motor (6), a second motor (7), a screw rod (8), a sliding seat (9), a first rotary shaft (10), a third motor (11), a fourth motor (12), a first bottom plate (13) and a second bottom plate (14), a bottom of the first bin shell (1) is open, and a top of the first bin shell (1) is provided with a first discharge opening (16), an air inlet of the first induced draft fan (2) communicates with the first discharge opening (16) through a first air duct (17), a front wall of the first bin shell (1) is provided with a first feeding opening (18), from which a rear part of the conveying mechanism (60) penetrates into the first bin shell (1), the pressuring roller (3) is movably installed on the first feeding opening (18) of the first bin shell (1), and located above the conveying mechanism (60), the first opening roller (4) is movably installed in the first bin shell (1), located at a rear end of the conveying mechanism (60), and first saw teeth (21) are set on a periphery of the first opening roller (4), the first motor (6) is connected with the first opening roller (4), the second opening roller (5) is movably installed in the first bin shell (1), and second saw teeth (23) are set on a periphery of the second opening roller (5), the second motor (7) is connected with the second opening roller (5), the first bottom plate (13) and the second bottom plate (14) are respectively fixedly installed in the first bin shell (1) below the first opening roller (4) and the second opening roller (5), the first bottom plate (13) and the second bottom plate (14) respectively present an arc shape corresponding to the first opening roller (4) and the second opening roller (5), an impurity-discharging hole (24) is set in the second bottom plate (14), an inner top of the first bin shell (1) is provided with a pair of supporting plates (40), between which a guiding column (41) is set, the third motor (11) is fixedly installed on an outer wall of the first bin shell (1), the screw rod (8) is movably installed on the pair of supporting plates (40), and one end of the screw rod (8) protrudes from the first bin shell (1) and is connected with the third motor (11), a through hole (43) and a screw hole (44) are set in the sliding seat (9), which movably encircles the guiding column (41) through the through hole (43), and the screw rod (8) is rotationally set in the screw hole (44) of the sliding seat (9), the first rotary shaft (10) is movably installed on the sliding seat (9), on which the fourth motor (12) is fixedly installed, and is connected to the first rotary shaft (10), and stirring rods (47) in a row are set on the first rotary shaft (10), the gravity impurity-removal mechanism (200) comprises a second bin shell (A1), a sixth motor (A2), a middle shaft (A3), a sieving hopper (A4), a seventh motor (A5), a second rotary shaft (A6), a cam (A7), a pulley (A8), a covering plate (A9) and a second induced draft fan (A10), a second feeding opening (A19) is set on a side of the second bin shell (A1), a top of the second bin shell (A1) is provided with a second discharging opening (A20), an air outlet of the first induced draft fan (2) communicates with the second feeding opening (A19) through a first pipe (S1), and an air inlet of the second induced draft fan (A10) communicates with the second discharging opening (A20) through a second air duct (A39), a bottom of the second bin shell (A1) is provided with a first impurity-discharging opening (A21), and the covering plate (A9) is hinged and set at the first impurity-discharging opening (A21) of the second bin shell (A1), a locking mechanism (A40) is set between the second bin shell (A1) and the covering plate (A9), a guiding hole (A29) is set on an inner side wall of the second bin shell (A1), the sieving hopper (A4) is located in the second bin shell (A1), a bottom of the sieving hopper (A4) is provided with a guiding column (A30), which is movably inserted in the guiding hole (A29), a first sieving hole (A31) is set in a bottom wall of the sieving hopper (A4), and an axis hole (A32) is set in a top wall of the second bin shell (A1), the middle shaft (A3) is movably inserted into the second bin shell (A1) through the axis hole (A32), and the sixth motor (A2) is connected to the middle shaft (A3), the middle shaft (A3) is provided with a transverse rod (A33), which is provided with a raking rod (A34), and the raking rod (A34) extends downward into the sieving hopper (A4), the second rotary shaft (A6) is movably inserted in the second bin shell (A1), and the cam (A7) is fixedly installed on the second rotary shaft (A6), the pulley (A8) is movably installed on the cam (A7), and the pulley (A8) is located under the bottom of the sieving hopper (A4), the seventh motor (A5) is connected with the second rotary shaft (A6), the drum impurity-removal mechanism (300) comprises a fourth bin shell (B1), a third induced draft fan (B2), a fourth induced draft fan (B3), a drum (B4), a thirteenth motor (B5), a fourteenth motor (B6), a connecting sleeve (B7), and a fourth rotary shaft (B9), a side part of the fourth bin shell (B1) is provided with a fourth feeding opening (B10), an air outlet of the second induced draft fan (A10) communicates with the fourth feeding opening (B10), the drum (B4) is movably installed in the fourth bin shell (B1), and is tube shaped, and first mesh (B12) is set on a peripheral wall of the drum (B4), a first scraper (B13) is set at the fourth feeding opening (B10) inside the fourth bin shell (B1), one end of the first scraper (B13) is configured to be adjacent to outer peripheral wall of the drum (B4), one end of the drum (B4) is provided with an impurity-discharging pipe (B14), an outer periphery of the impurity-discharging pipe (B14) is provide with an annular hump (B15), the connecting sleeve (B7) is fixedly installed on an outer wall of the fourth bin shell (B1), and the impurity-discharging pipe (B14) is movably mounted in the connecting sleeve (B7) with the annular hump (B15), and communicates with the connecting sleeve (B7), the third induced draft fan (B2) communicates with the connecting sleeve (B7) through a third air duct (B16), and the thirteenth motor (B5) is connected with the drum (B4), a bottom of the fourth bin shell (B1) is provided with a discharging pipe (B19), two side walls of the discharging pipe (B19) are respectively provided with arc plates (B20) having a same center of circle and same radius, an impurity-absorbing cavity (B21) is set on an outer side of the arc plate (B20) at one side, and second mesh (B22) communicating with the impurity-absorbing cavity (B21) is set on that arc plate (B20), and an impurity-outlet (B23) is set on an outer wall of the impurity-absorbing cavity (B21), the fourth induced draft fan (B3) communicates with the impurity-outlet (B23) through a fourth air duct (B24), the fourth rotatory shaft (B9) is movably inserted in the discharging pipe (B19), and a second scraper (B26) is set on the fourth rotatory shaft (B9), one end of the second scraper (B26) is configured to be adjacent to an inner side wall of the arc plate (B21), the fourteenth motor (B6) is connected with the fourth shaft (B9), the secondary opening-and-impurity-removal mechanism (400) comprises a third bin shell (C1), a pair of first lickers-in (C2), a second licker-in (C3), an eighth motor (C4), a ninth motor (C5), a vibrating sieve plate (C6), a tenth motor (C7), a third rotatory shaft (C8), a connecting rod (C9), a conveying shaft (C10), an eleventh motor (C11), a third opening roller (C12) and a twelfth motor (C13), a third feeding opening (C17) is set in a top of the third bin shell (C1), and the discharging pipe (B19) is connected to the third feeding opening (C17) through a second pipe (S2), a division plate (C14) is set in the third bin shell (C1), and an impurity-discharging channel (C15) is formed between the division plate (C14) and an inner wall of one side of the third bin shell (C1), a bottom of the third bin shell (C1) is provided with a conveying trough (C18), at a bottom of the conveying trough (C18) a second impurity-discharging opening (C19) is set, a lifting channel (C20) communicating with an inside of the third bin shell (C1) is set in a side of the third bin shell (C1), and a third discharging opening (C21) is set at an upper end of the lifting channel (C20), an impurity-leaking plate (C22) is set in the third bin shell (C1) and the lifting channel (C20), and two ends of the impurity-leaking plate (C22) are fixed at the division plate (C14) and the third discharging opening (C21) of the lifting channel (C20), the pair of first lickers-in (C2) are respectively movably installed at the third feeding opening (C17) of the third bin shell (C1), a periphery of the first lickers-in (C2) is provide with a first spike (C50), and the eighth motor (C4) is connected with the pair of first lickers-in (C2), the second licker-in (C3) is movably installed in the third bin shell (C1) below the pair of the first lickers-in (C2), a second spike (CM) is set on a periphery of the second licker-in (C3), and the ninth motor (C5) is connected with the second licker-in (C3), the third rotatory shaft (C8) is movably inserted in the third bin shell (C1), and a flying wheel disk (C33) is set on the third rotatory shaft (C8), one end of the vibrating sieve plate (C6) is hinged to an inner wall of the third bin shell (C1), one end of the connecting rod (C9) is hinged to the flying wheel disk (C33), and the other end of the connecting rod (C9) is hinged to the other end of the vibrating sieve plate (C6), the vibrating sieve plate (C6) is located above the impurity-discharging channel (C15) and below the second licker-in (C3), a second sieving hole (C37) is set on the vibrating sieve plate (C6), and the tenth motor (C7) is fixedly installed on the third bin shell (C1), and connected with the third rotatory shaft (C8), the conveying shaft (C10) is movably installed in the conveying trough (C18), and a spiral rib plate (C40) is set on the conveying shaft (C10), the third opening roller (C12) is movably installed in the third bin shell (C1) and the lifting channel (C20) with an incline, third saw teeth (C43) are set on a periphery of the third opening roller (C12), the impurity-leaking plate (C22) is located below the third opening roller (C12), and continuous arcs of the impurity-leaking plate (C22) are configured to respectively correspond to the third opening rollers (C12), impurity-leaking holes (C44) are set in the impurity-leaking plate (C22), and the twelfth motor (C13) is in connected with the third opening rollers (C12) in a row.

2. The impurity removal system for refining cotton according to claim 1, wherein, the opening-and-impurity-removal mechanism (100) is provided with a pair of corrugated dust-proof sleeves (15), the pair of corrugated dust-proof sleeves (15) respectively encircle an outside of the screw rod (8), one end of the pair of corrugated dust-proof sleeves (15) is fixedly connected with the sliding seat (9), and the other end of the pair of corrugated dust-proof sleeves (15) is fixedly connected with the pair of supporting plates (40).

3. The impurity removal system for refining cotton according to claim 1, wherein the conveying mechanism (60) comprises a frame (31), conveying rollers (32), a conveying belt (33) and a fifth motor (34), the conveying rollers (32) are movably installed in a row on the frame (31) through a third bearing (35), a pair of lateral obstructing plates (36) are set on the frame (31), and located on both sides of the conveying roller (32), the conveying belt (33) is wound on the conveying rollers (32) in a row, and a fifth belt pulley (37) is set on the conveying roller (32) at rearmost end, the fifth motor (34) is fixedly installed on the first bin shell (1), and a sixth belt pulley (38) is set on an output shaft of the fifth motor (34), and is connected to the fifth belt pulley (37) with a belt (39).

4. The impurity removal system for refining cotton according to claim 2, wherein, the conveying mechanism (60) comprises a frame (31), conveying rollers (32), a conveying belt (33) and a fifth motor (34), the conveying rollers (32) are movably installed in a row on the frame (31) through a third bearing (35), a pair of lateral obstructing plates (36) are set on the frame (31), and located on both sides of the conveying roller (32), the conveying belt (33) is wound on the conveying rollers (32) in a row, and a fifth belt pulley (37) is set on the conveying roller (32) at rearmost end, the fifth motor (34) is fixedly installed on the first bin shell (1), and a sixth belt pulley (38) is set on an output shaft of the fifth motor (34), and is connected to the fifth belt pulley (37) with a belt (39).

5. The impurity removal system for refining cotton according to claim 1, wherein, the first opening roller (4) is movably installed in the first bin shell (1) through a first bearing (20), the second opening roller (5) is movably installed in the first bin shell (1) through a second bearing (22), the first motor (6) and the second motor (7) are respectively fixedly installed on a side wall of the first bin shell (1), a first belt pulley (25) is set at one end of the first opening roller (4), and a second belt pulley (26) is set on an output shaft of the first motor (6), and connected to the first belt pulley (25) with a belt (27), a third belt pulley (28) is set at one end of the second opening roller (5), a fourth belt pulley (29) is set on an output shaft of the second motor (7), and connected to the third pulley (28) with a belt (30), the pressuring roller (3) is movably installed at the first feeding opening (18) of the first bin shell (1) through a fourth bearing (19), one end of the screw rod (8) protrudes from the first bin shell (1) and is connected with the third motor (11) through a first coupling (42), the first rotatory shaft (10) is movably installed on the sliding seat (9) through a fifth bearing (45), the fourth motor (12) is connected to the first rotatory shaft (10) through a second coupling (46).

6. The impurity removal system for refining cotton according to claim 2, wherein, the first opening roller (4) is movably installed in the first bin shell (1) through a first bearing (20), the second opening roller (5) is movably installed in the first bin shell (1) through a second bearing (22), the first motor (6) and the second motor (7) are respectively fixedly installed on a side wall of the first bin shell (1), a first belt pulley (25) is set at one end of the first opening roller (4), and a second belt pulley (26) is set on an output shaft of the first motor (6), and connected to the first belt pulley (25) with a belt (27), a third belt pulley (28) is set at one end of the second opening roller (5), a fourth belt pulley (29) is set on an output shaft of the second motor (7), and connected to the third pulley (28) with a belt (30), the pressuring roller (3) is movably installed at the first feeding opening (18) of the first bin shell (1) through a fourth bearing (19), one end of the screw rod (8) protrudes from the first bin shell (1) and is connected with the third motor (11) through a first coupling (42), the first rotatory shaft (10) is movably installed on the sliding seat (9) through a fifth bearing (45), the fourth motor (12) is connected to the first rotatory shaft (10) through a second coupling (46).

7. The impurity removal system for refining cotton according to claim 1, wherein, the gravity impurity-removal mechanism (200) further comprises a sealing gasket (A18), a bearing seat (A11), a thrust bearing (A12), a first radial bearing (A13), a first sealing ring (A14), a shaft sleeve (A15), a second radial bearing (A16) and a second sealing ring (A17), a flange plate (A22) is set at the first impurity-discharging opening (A21) of the second bin shell (A1), and the covering plate (A9) is hinged with the flange plate (A22) through a hinge (A23), the sealing gasket (A18) is fixedly installed on the flange plate (A22), the locking mechanism (A40) comprises a locking screw stem (A24) and a locking nut (A25), the locking screw stem (A24) is movably installed on the covering plate (A9) through a hinge pin (A26), a lock plate (A27) is set on the flange plate (A22), and the lock plate (A27) is provided with a lock groove (A28), in which the locking screw stem (A24) is accommodated, the locking nut (A25) is screwed on the locking screw stem (A24) and pressed against the lock plate (A27), and the covering plate (A9) is pressed against the sealing gasket (A18), the bearing seat (A11) fixedly installed on the second bin shell (A1), and the thrust bearing (A12) and the first radial bearing (A13) are respectively installed in the bearing seat (A11), the middle shaft (A3) is inserted in the bearing seat (A11), and a supporting seat (A35) is set on the middle shaft (A3) located in the bearing seat (A11), the supporting seat (A35) is set on the thrust bearing (A12), and the first radial bearing (A13) encircles an outside of the supporting seat (A35), the sixth motor (A2) is fixedly installed on the bearing seat (A11), and fixedly connected to the supporting seat (A35) through a second coupling (A36), the first sealing ring (A14) is fixed in the axis hole (A32) of the second bin shell (A1) and set outside the middle shaft (A3), the shaft sleeve (A15) is fixedly installed on the second bin shell (A1), and the second rotatory shaft (A6) is movably inserted in the shaft sleeve (A15) through the second radial bearing (A16), the second sealing ring (A17) is fixed in the shaft sleeve (A15) and encircles an outside of the second rotatory shaft (A6), the seventh motor (A5) is fixedly installed on the shaft sleeve (A15), and the seventh motor (A5) is connected with the second rotatory shaft (A6) through a third coupling (A38).

8. The impurity removal system for refining cotton according to claim 2, wherein, the gravity impurity-removal mechanism (200) further comprises a sealing gasket (A18), a bearing seat (A11), a thrust bearing (A12), a first radial bearing (A13), a first sealing ring (A14), a shaft sleeve (A15), a second radial bearing (A16) and a second sealing ring (A17), a flange plate (A22) is set at the first impurity-discharging opening (A21) of the second bin shell (A1), and the covering plate (A9) is hinged with the flange plate (A22) through a hinge (A23), the sealing gasket (A18) is fixedly installed on the flange plate (A22), the locking mechanism (A40) comprises a locking screw stem (A24) and a locking nut (A25), the locking screw stem (A24) is movably installed on the covering plate (A9) through a hinge pin (A26), a lock plate (A27) is set on the flange plate (A22), and the lock plate (A27) is provided with a lock groove (A28), in which the locking screw stem (A24) is accommodated, the locking nut (A25) is screwed on the locking screw stem (A24) and pressed against the lock plate (A27), and the covering plate (A9) is pressed against the sealing gasket (A18), the bearing seat (A11) fixedly installed on the second bin shell (A1), and the thrust bearing (A12) and the first radial bearing (A13) are respectively installed in the bearing seat (A11), the middle shaft (A3) is inserted in the bearing seat (A11), and a supporting seat (A35) is set on the middle shaft (A3) located in the bearing seat (A11), the supporting seat (A35) is set on the thrust bearing (A12), and the first radial bearing (A13) encircles an outside of the supporting seat (A35), the sixth motor (A2) is fixedly installed on the bearing seat (A11), and fixedly connected to the supporting seat (A35) through a second coupling (A36), the first sealing ring (A14) is fixed in the axis hole (A32) of the second bin shell (A1) and set outside the middle shaft (A3), the shaft sleeve (A15) is fixedly installed on the second bin shell (A1), and the second rotatory shaft (A6) is movably inserted in the shaft sleeve (A15) through the second radial bearing (A16), the second sealing ring (A17) is fixed in the shaft sleeve (A15) and encircles an outside of the second rotatory shaft (A6), the seventh motor (A5) is fixedly installed on the shaft sleeve (A15), and the seventh motor (A5) is connected with the second rotatory shaft (A6) through a third coupling (A38).

9. The impurity removal system for refining cotton according to claim 1, wherein, through a sixth bearing (C23), the pair of first lickers-in (C2) are respectively movably installed in the third bin shell (C1), the eighth motor (C4) is fixedly installed on the third bin shell (C1), a first gear (C24) is set at one end of each of the pair of first lickers-in (C2), respectively, and the first gears (C24) between the pair of first lickers-in (C2) mesh each other, a seventh belt pulley (C25) is set at the other end of one of the pair of first lickers-in (C2), and an eighth belt pulley (C26) is set on an output shaft of the eighth motor (C4), and is connected to the seventh belt pulley (C25) with a belt (C27), the second licker-in (C3) is movably installed in the third bin shell (C1) through a seventh bearing (C28), and a ninth belt pulley (C29) is set at one end of the second licker-in (C3), the ninth motor (C5) is fixedly installed on the third bin shell (C1), and a tenth belt pulley (C30) is set on an output shaft of the ninth motor (C5), and is belt drivingly connected to the ninth belt pulley (C29) with a belt (C31).

10. The impurity removal system for refining cotton according to claim 2, wherein, through a sixth bearing (C23), the pair of first lickers-in (C2) are respectively movably installed in the third bin shell (C1), the eighth motor (C4) is fixedly installed on the third bin shell (C1), a first gear (C24) is set at one end of each of the pair of first lickers-in (C2), respectively, and the first gears (C24) between the pair of first lickers-in (C2) mesh each other, a seventh belt pulley (C25) is set at the other end of one of the pair of first lickers-in (C2), and an eighth belt pulley (C26) is set on an output shaft of the eighth motor (C4), and is connected to the seventh belt pulley (C25) with a belt (C27), the second licker-in (C3) is movably installed in the third bin shell (C1) through a seventh bearing (C28), and a ninth belt pulley (C29) is set at one end of the second licker-in (C3), the ninth motor (C5) is fixedly installed on the third bin shell (C1), and a tenth belt pulley (C30) is set on an output shaft of the ninth motor (C5), and is connected to the ninth belt pulley (C29) with a belt (C31).

11. The impurity removal system for refining cotton according to claim 1, wherein, the third rotatory shaft (C8) is movably inserted into the third bin shell (C1) through an eighth bearing (C32), one end of the vibrating sieve plate (C6) is hinged to the inner wall of the third bin shell (C1) through a first pivoting shaft (C34), one end of the connecting rod (C9) is hinged to the flying wheel disk (C33) through a second pivoting shaft (C35), and the other end of the connecting rod (C9) is hinged to the other end of the vibrating sieve plate (C6) through a third pivoting shaft (C36), the tenth motor (C7) is fixedly installed on the third bin shell (C1), and connected with the third rotatory shaft (C8) through a ninth coupling (C38), and the eleventh motor (C11) is fixedly installed on the third bin shell (C1), and connected to the conveying shaft (C10) through a fifth coupling (C41).

12. The impurity removal system for refining cotton according to claim 2, wherein, the third rotatory shaft (C8) is movably inserted into the third bin shell (C1) through an eighth bearing (C32), one end of the vibrating sieve plate (C6) is hinged to the inner wall of the third bin shell (C1) through a first pivoting shaft (C34), one end of the connecting rod (C9) is hinged to the flying wheel disk (C33) through a second pivoting shaft (C35), and the other end of the connecting rod (C9) is hinged to the other end of the vibrating sieve plate (C6) through a third pivoting shaft (C36), the tenth motor (C7) is fixedly installed on the third bin shell (C1), and connected with the third rotatory shaft (C8) through a ninth coupling (C38), and the eleventh motor (C11) is fixedly installed on the third bin shell (C1), and connected to the conveying shaft (C10) through a fifth coupling (C41).

13. The impurity removal system for refining cotton according to claim 1, wherein, the third opening rollers (C12) are movably installed in the third bin shell (C1) and the lifting channel (C20) by a ninth bearing (C42) respectively, an eleventh belt pulley (C45) is set at one end of adjacent third opening rollers (C12), and the eleventh belt pulleys (C45) between the adjacent third opening rollers (C12) are connected to each other with a belt (C46), a twelfth belt pulley (C47) is set at the other end of one of the third opening rollers (C12), the twelfth motor (C13) is fixedly installed on the third bin shell (C1), and a thirteenth belt pulley (C48) is set on an output shaft of the twelfth motor (C13), and is connected to the twelfth belt pulley (C47) with a belt (C49).

14. The impurity removal system for refining cotton according to claim 2, wherein, the third opening rollers (C12) are movably installed in the third bin shell (C1) and the lifting channel (C20) by a ninth bearing (C42) respectively, an eleventh belt pulley (C45) is set at one end of adjacent third opening rollers (C12), and the eleventh belt pulleys (C45) between the adjacent third opening rollers (C12) are connected to each other with a belt (C46), a twelfth belt pulley (C47) is set at the other end of one of the third opening rollers (C12), the twelfth motor (C13) is fixedly installed on the third bin shell (C1), and a thirteenth belt pulley (C48) is set on an output shaft of the twelfth motor (C13), and is connected to the twelfth belt pulley (C47) with a belt (C49).

15. The impurity removal system for refining cotton according to claim 1, wherein, the drum impurity-removal mechanism (300) further comprises a third sealing ring (B8), the third sealing ring (B8) is fixed in the connecting sleeve (B7) and encircles an outside of the annular hump (B15), the drum (B4) is movably installed in the fourth bin shell (B1) through an eleventh bearing (B11), and the thirteenth motor (B5) is fixedly installed on the fourth bin shell (B1), a second gear (B17) is set at the other end of the drum (B4), and a third gear (B18) is set on an output shaft of the thirteenth motor (B5), and meshes with the second gear (B17), the fourth rotary shaft (B9) is movably inserted in the discharging pipe (B19) through a twelfth bearing (B25), the fourteenth motor (B6) is fixedly installed on the discharging pipe (B19), and is connected with the fourth rotatory shaft (B9) through a sixth coupling (B27).

16. The impurity removal system for refining cotton according to claim 2, wherein, the drum impurity-removal mechanism (300) further comprises a third sealing ring (B8), the third sealing ring (B8) is fixed in the connecting sleeve (B7) and encircles an outside of the annular hump (B15), the drum (B4) is movably installed in the fourth bin shell (B1) through an eleventh bearing (B11), and the thirteenth motor (B5) is fixedly installed on the fourth bin shell (B1), a second gear (B17) is set at the other end of the drum (B4), and a third gear (B18) is set on an output shaft of the thirteenth motor (B5), and meshes with the second gear (B17), the fourth rotary shaft (B9) is movably inserted in the discharging pipe (B19) through a twelfth bearing (B25), the fourteenth motor (B6) is fixedly installed on the discharging pipe (B19), and is connected with the fourth rotatory shaft (B9) through a sixth coupling (B27).

* * * * *